US007830315B2

(12) United States Patent
Sugiyama et al.

(10) Patent No.: US 7,830,315 B2
(45) Date of Patent: Nov. 9, 2010

(54) ANTENNA APPARATUS AND RADIO COMMUNICATING APPARATUS

(75) Inventors: Yuuichi Sugiyama, Kawasaki (JP); Kouji Soekawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 104 days.

(21) Appl. No.: 11/864,462

(22) Filed: Sep. 28, 2007

(65) Prior Publication Data

US 2008/0150810 A1 Jun. 26, 2008

(30) Foreign Application Priority Data

Dec. 21, 2006 (JP) ..... 2006-344795

(51) Int. Cl.
*H01Q 1/24* (2006.01)
*H01Q 1/36* (2006.01)

(52) U.S. Cl. ..... 343/702; 343/700 R

(58) Field of Classification Search ..... 343/702
See application file for complete search history.

(56) References Cited

U.S. PATENT DOCUMENTS

| | | | | |
|---|---|---|---|---|
| 6,958,730 | B2 * | 10/2005 | Nagumo et al. | 343/702 |
| 2002/0163470 | A1 * | 11/2002 | Nagumo et al. | 343/700 MS |
| 2005/0122267 | A1 * | 6/2005 | Sim et al. | 343/702 |
| 2005/0128151 | A1 * | 6/2005 | Kwak et al. | 343/702 |
| 2005/0134509 | A1 * | 6/2005 | Lin | 343/702 |
| 2005/0140554 | A1 * | 6/2005 | Wang et al. | 343/702 |
| 2005/0184914 | A1 * | 8/2005 | Ollikainen et al. | 343/702 |
| 2005/0200537 | A1 * | 9/2005 | Jarmuszewski et al. | 343/702 |
| 2005/0225488 | A1 * | 10/2005 | Nakagawa et al. | 343/702 |
| 2005/0270240 | A1 * | 12/2005 | Qi et al. | 343/702 |
| 2005/0270241 | A1 * | 12/2005 | Qi et al. | 343/702 |
| 2005/0270242 | A1 * | 12/2005 | Qi et al. | 343/702 |
| 2006/0145923 | A1 * | 7/2006 | Autti | 343/700 MS |
| 2006/0145934 | A1 * | 7/2006 | Park et al. | 343/702 |
| 2006/0152411 | A1 * | 7/2006 | Iguchi et al. | 343/700 MS |
| 2006/0181464 | A1 * | 8/2006 | Erkocevic | 343/702 |
| 2006/0192712 | A1 * | 8/2006 | Park et al. | 343/700 MS |
| 2006/0197705 | A1 * | 9/2006 | Chen et al. | 343/700 MS |
| 2006/0208952 | A1 * | 9/2006 | Qi et al. | 343/702 |
| 2006/0214858 | A1 * | 9/2006 | Qi et al. | 343/702 |

FOREIGN PATENT DOCUMENTS

| | | | |
|---|---|---|---|
| JP | 5-283926 | A | 10/1993 |
| JP | 2002-330025 | A | 11/2002 |
| JP | 2003-37426 | A | 2/2003 |

* cited by examiner

*Primary Examiner*—Rexford N Barnie
*Assistant Examiner*—Matthew C Tabler
(74) *Attorney, Agent, or Firm*—Westerman, Hattori, Daniels & Adrian, LLP

(57) ABSTRACT

The present invention relates to an antenna apparatus capable of multifrequency resonance and realizes downsizing and multifrequency resonance. The present invention relates to an antenna apparatus capable of multifrequency resonance or a radio communicating apparatus (e.g., portable phone) including the antenna apparatus; toward a feed element connected to and supplied with electricity from a feeding unit of a circuit substrate (printed circuit substrate), a non-feed element is disposed with over the circuit substrate or outside the circuit substrate; and the feed side or the open side of the feed element is electromagnetically coupled to the non-feed element to enable resonance in the frequency band of the non-feed element in addition to resonance in the frequency band of the feed element.

27 Claims, 40 Drawing Sheets

((DEFAULT)

(MOVED BY Δd=4mm)

(MOVED BY Δd=8mm)

(DEFAULT)

(MOVED BY Δd=4mm)

(MOVED BY Δd=8mm)

(DEFAULT)

(MOVED BY Δd=4mm)

(MOVED BY Δd=8mm)

(DEFAULT)

(MOVED BY Δd=4mm)

(MOVED BY Δd=8mm)

(DEFAULT)

(MOVED BY Δd=4mm)

(MOVED BY Δd=8mm)

ANTENNA APPARATUS AND RADIO COMMUNICATING APPARATUS

CROSS-REFERENCE TO RELATED APPLICATIONS

This application is based upon and claims the benefit of priority from the prior Japanese Patent Application No. 2006-344795, filed on Dec. 21, 2006, the entire contents of which are incorporated herein by reference.

BACKGROUND OF THE INVENTION

1. Field of the Invention

The present invention relates generally to a multifrequency resonant antenna, and more particularly, to an antenna apparatus including a plurality of elements and to a radio communicating apparatus.

2. Description of the Related Art

Recently, communication using a plurality of frequencies such as GPS (Global Positioning System) communication and telephone communication is increasingly diversified in radio communicating apparatuses such as portable terminal apparatuses. When using a plurality of frequencies, if an independent antenna is disposed for each frequency band, proportion of antenna is increased in a radio communicating apparatus. Therefore, it is requested to use a single antenna apparatus in a plurality of frequency bands.

With regard to an antenna apparatus corresponding to a plurality of frequency bands, in an antenna apparatus disclosed in Japanese Patent Application Laid-Open Publication No. 2002-330025, a non-feed radiation electrode is disposed on each branch radiation electrode of a feed radiation electrode, which is split into two branch radiation electrodes, and the branch radiation electrode and the non-feed radiation electrode on one side and the branch radiation electrode and the non-feed radiation electrode on the other side are driven into multiple resonance in different frequency bands (abstract, FIG. 3, etc.).

Japanese Patent Application Laid-Open Publication No. H05-283926 discloses a dipole antenna that includes a non-feed element in a surface surrounded by a folding dipole element to realize band sharing characteristics for a plurality of frequency bands (abstract, FIG. 1, etc.).

Japanese Patent Application Laid-Open Publication No. 2003-037426 discloses a helical antenna operable in a plurality of frequency bands that includes two non-feed coil units among windings of an excitation coil unit and the non-feed coil units are electromagnetically coupled to the excitation coil unit and are fed from the excitation coil unit (abstract, FIG. 5, etc.).

Since the non-feed elements are connected to ground in the antenna apparatus disclosed in Japanese Patent Application Laid-Open Publication No. 2002-330025, a ground terminal unit is needed; an occupied area is increased in the dipole antenna disclosed in Japanese Patent Application Laid-Open Publication No. H05-283926; and the helical antenna disclosed in Japanese Patent Application Laid-Open Publication No. 2003-037426 is a narrow-band antenna.

Although the multifrequency resonance can be achieved by branching an antenna element, in the case of a communicating apparatus that cannot ensure a sufficient space for disposing an antenna element when the antenna element is branched, it is disadvantageous that the multifrequency resonance cannot be achieved or that necessary antenna characteristics cannot be achieved.

In Japanese Patent Application Laid-Open Publication Nos. 2002-330025, H05-283926, and 2003-037426, such requirements and problems are not disclosed or indicated, and structure, etc., for solving the problems are not disclosed or indicated.

SUMMARY OF THE INVENTION

An object of the present invention relates to an antenna apparatus capable of multifrequency resonance and is to realize downsizing and multifrequency resonance.

An object of the present invention relates to an antenna apparatus capable of multifrequency resonance and is to realize multifrequency resonance in a small disposition space such as a flat disposition space.

Another object of the present invention relates to a radio communicating apparatus including an antenna apparatus capable of multifrequency resonance and is to reduce occupancy proportion of the antenna apparatus to the radio communicating apparatus.

In order to achieve the above objects, the present invention relates to an antenna apparatus capable of multifrequency resonance and a radio communicating apparatus including the antenna apparatus; a feed element connected to and supplied with electricity from a feeding unit (feeding point) of a circuit substrate is disposed with a non-feed element over the circuit substrate or outside the circuit substrate; and the feed side or the open side of the feed element is electromagnetically coupled to the non-feed element to enable resonance in the frequency band of the non-feed element in addition to resonance in the frequency band of the feed element to achieve the above objects.

To achieve the above objects, according to a first aspect of the present invention there is provided an antenna apparatus capable of multitrequency resonance, comprising a feed element supplied with electricity; a single or a plurality of non-feed element(s) disposed over a circuit substrate or outside the circuit substrate having a feeding portion disposed for supplying electricity to the feed element; and a single or a plurality of coupling portion(s) that electromagnetically couples the feed element to the non-feed element(s), the antenna apparatus resonating in a frequency band of the feed element, the antenna apparatus resonating in a frequency band of the non-feed element.

Preferably, in the antenna apparatus, the coupling portion may be one or both of a feed-side coupling portion that electromagnetically couples a feed side of the feed element to the non-teed element and an open-side coupling portion that electromagnetically couples an open side of the feed element to the nonfeed element. The coupling portion may have a coupling strength that is changed depending on a distance between the feed element and the non-feed element. The feed element may include a feed connecting unit connected to the feeding portion and a plurality of antenna element units branched from the feed connecting unit, the antenna element units each having a resonant frequency different for each antenna element unit. The feed element may be located with an element portion bent within a width corresponding to a width of the circuit substrate to establish an antenna length necessary for resonance in a frequency band that should be set.

Preferably, in the antenna apparatus, the feed element may connect a feed connecting unit to the feeding portion of the circuit substrate and locate an element portion outside the circuit substrate. The feed element may include an element portion located parallel to an edge of the circuit substrate. The non-feed element may include an element portion disposed in the vicinity of the feed element connected to the feeding portion of the circuit substrate. The non-feed element may include an element portion disposed in the vicinity of an open side of the feed element. The non-feed element may include an element portion located parallel to the feed element. The non-feed element may include an element portion having a folding back portion bent on a feed side of the feed element and the folding back portion may be set as the feed-side coupling portion. The non-feed element may include an element portion having a folding back portion bent on an open side of the feed element and the folding back portion may be set as an open-side coupling portion. The feed element may be disposed on a dielectric material. The non-feed element may be supported by a housing with the circuit substrate built therein.

To achieve the above objects, according to a second aspect of the present invention there is provided a radio communicating apparatus using an antenna apparatus capable of multifrequency resonance, comprising a feed element supplied with electricity; a single or a plurality of non-feed element(s) disposed over a circuit substrate or outside the circuit substrate having a feeding portion disposed for supplying electricity to the feed element; and a single or a plurality of coupling portion(s) that electromagnetically couples the feed element to the non-feed element(s), the antenna apparatus resonating in a frequency band of the feed element, the antenna apparatus resonating in a frequency band of the non-feed element.

Preferably, the coupling portion may be one or both of a feed-side coupling portion that electromagnetically couples a feed side of the feed element to the non-feed element and an open-side coupling portion that electromagnetically couples an open side of the feed element to the non-feed element. The feed element may include a feed connecting unit connected to the feeding portion and a plurality of element portions branched from the feed connecting unit, the element portions each having a resonant frequency different for each element portion. The feed element may be located with an element portion bent within a width corresponding to a width of the circuit substrate to establish an antenna length necessary for resonance in a frequency band that should be set. The feed element may connect a feed connecting unit to the feeding portion of the circuit substrate and locate an element portion outside the circuit substrate.

Preferably, in the radio communicating apparatus, the feed element may include an element portion located parallel to an edge of the circuit substrate. The non-feed element may include an element portion disposed in the vicinity of the feed element connected to the feeding point of the circuit substrate. The non-feed element may include an0 element portion disposed in the vicinity of an open side of the feed element. The non-feed element may include an element portion located parallel to the feed element. The non-feed element nay include an element portion having a folding back portion bent on a feed side of the feed element and the folding back portion may be set as the feed-side coupling portion.

The non-feed element may include an element portion having a folding back portion bent on an open side of the feed element and the folding back portion may be set as an open-side coupling portion. The feed element may be disposed on a dielectric material. The non-feed element may be supported by a housing with the circuit substrate built therein.

The features and advantages of the present invention are listed as follows.

(1) An antenna apparatus can be downsized and multifrequency resonance is realized.

(2) An antenna apparatus can be downsized to realize multifrequency resonance in a small disposition space such as a flat disposition space.

(3) According to a radio communicating apparatus using such an antenna apparatus, occupancy proportion of the antenna apparatus can be reduced in the radio communicating apparatus and the radio communicating apparatus can be miniaturized.

Other objects, features, and advantages of the present invention will become more apparent by reference to the accompanying drawings and each embodiment.

DETAILED DESCRIPTION OF THE PREFERRED EMBODIMENTS

First Embodiment

Figure 1:
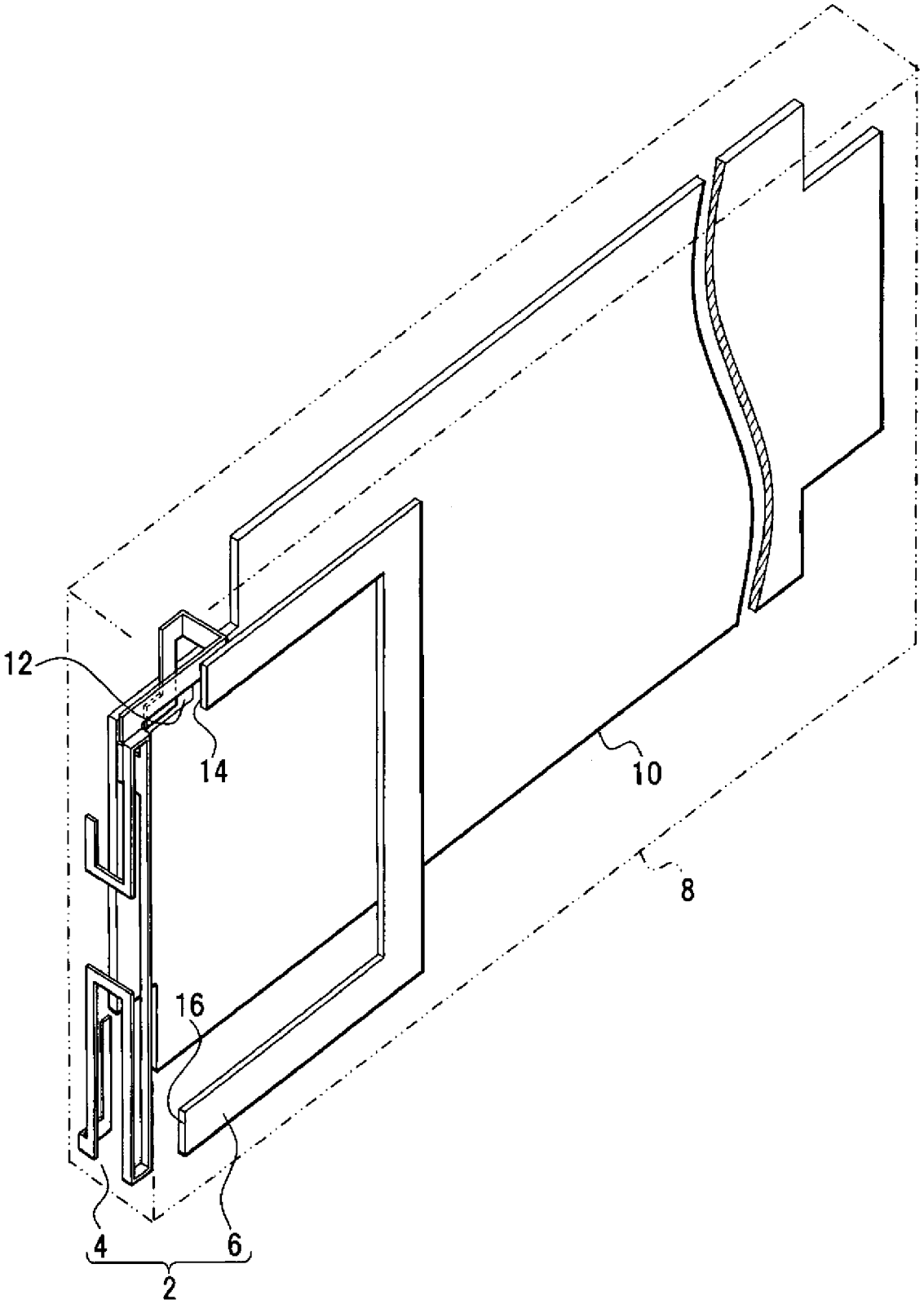
FIG. 1 is a perspective view of an outline of an antenna apparatus and a radio communicating apparatus using the antenna apparatus according to a first embodiment.
Figure 2:
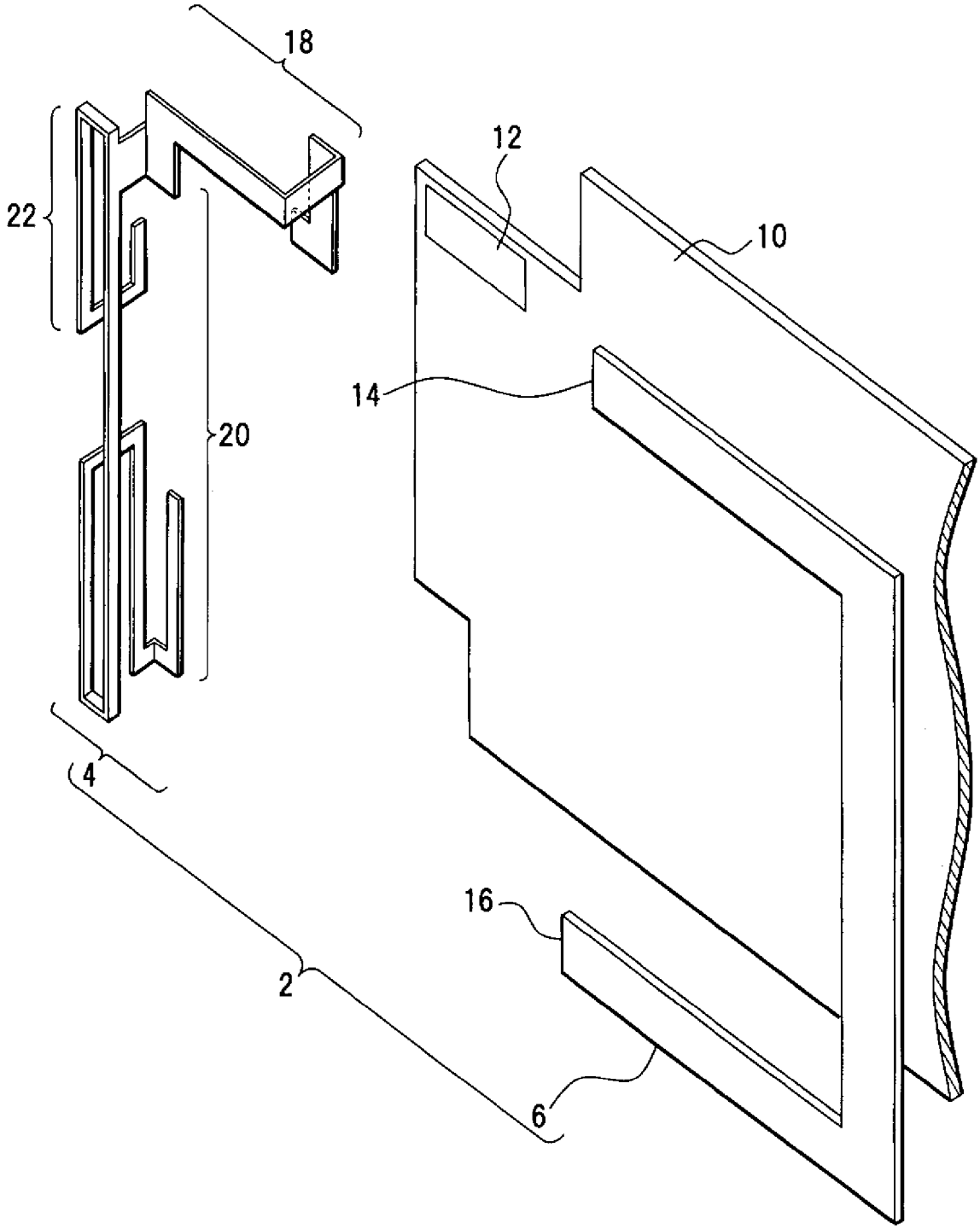
FIG. 2 is an exploded perspective view of the antenna apparatus.
Figure 3:
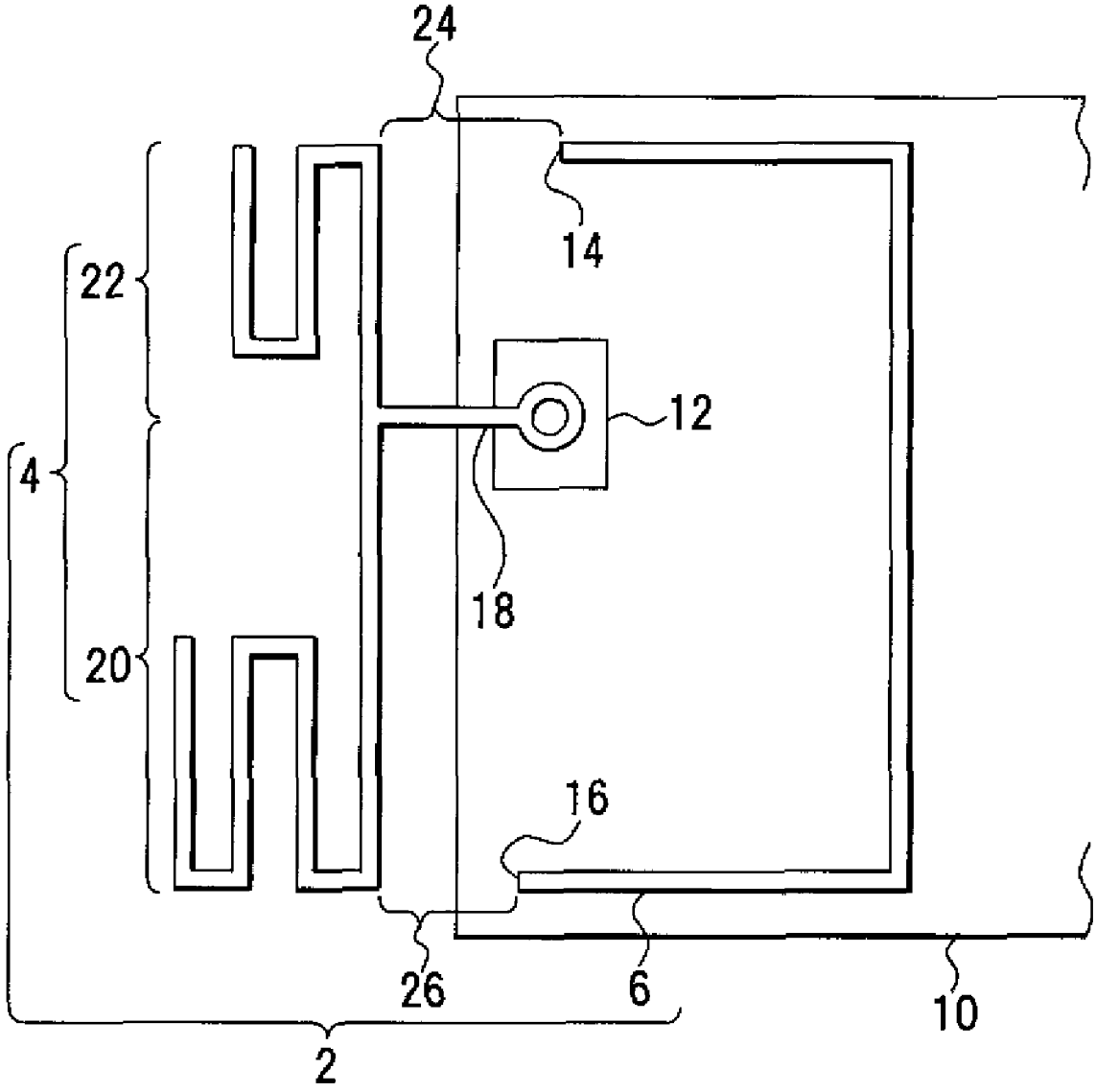
FIG. 3 depicts arrangement of a feed element, non-feed element, and printed circuit substrate.
Figure 4:
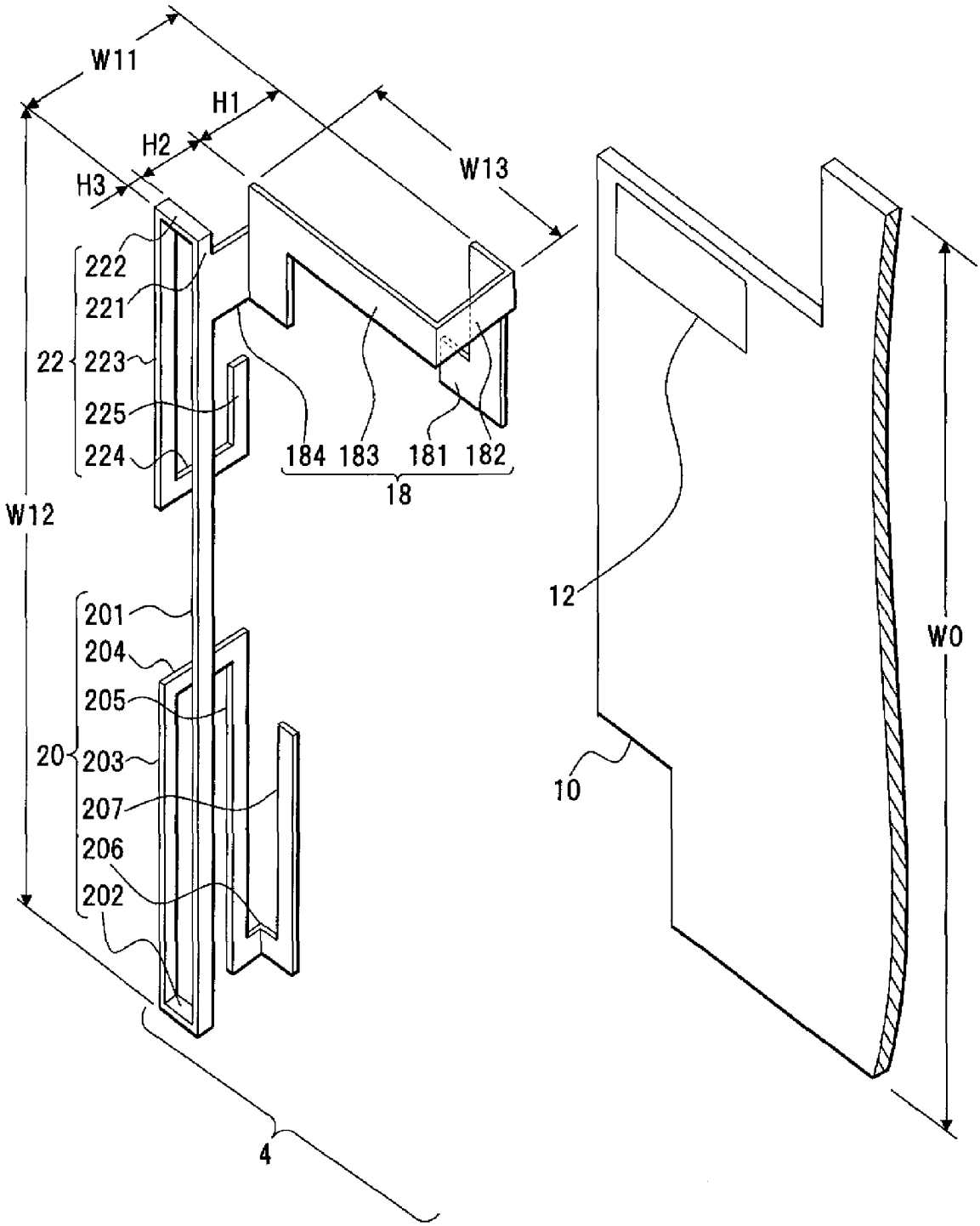
FIG. 4 is a perspective view of the feed element and the printed circuit substrate.
Figure 5:
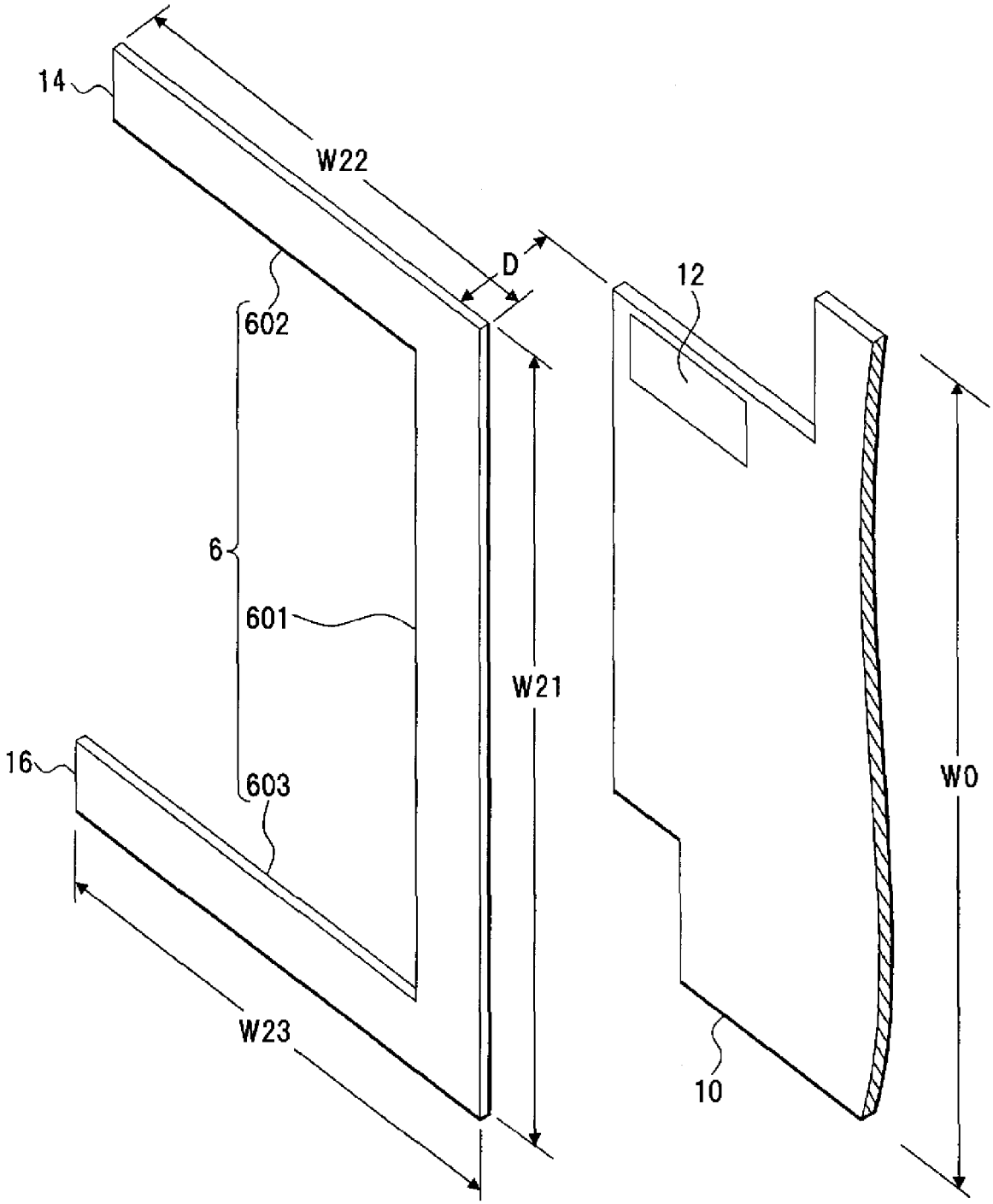
FIG. 5 is a perspective view of the non-feed element and the printed circuit substrate.
Figure 6:
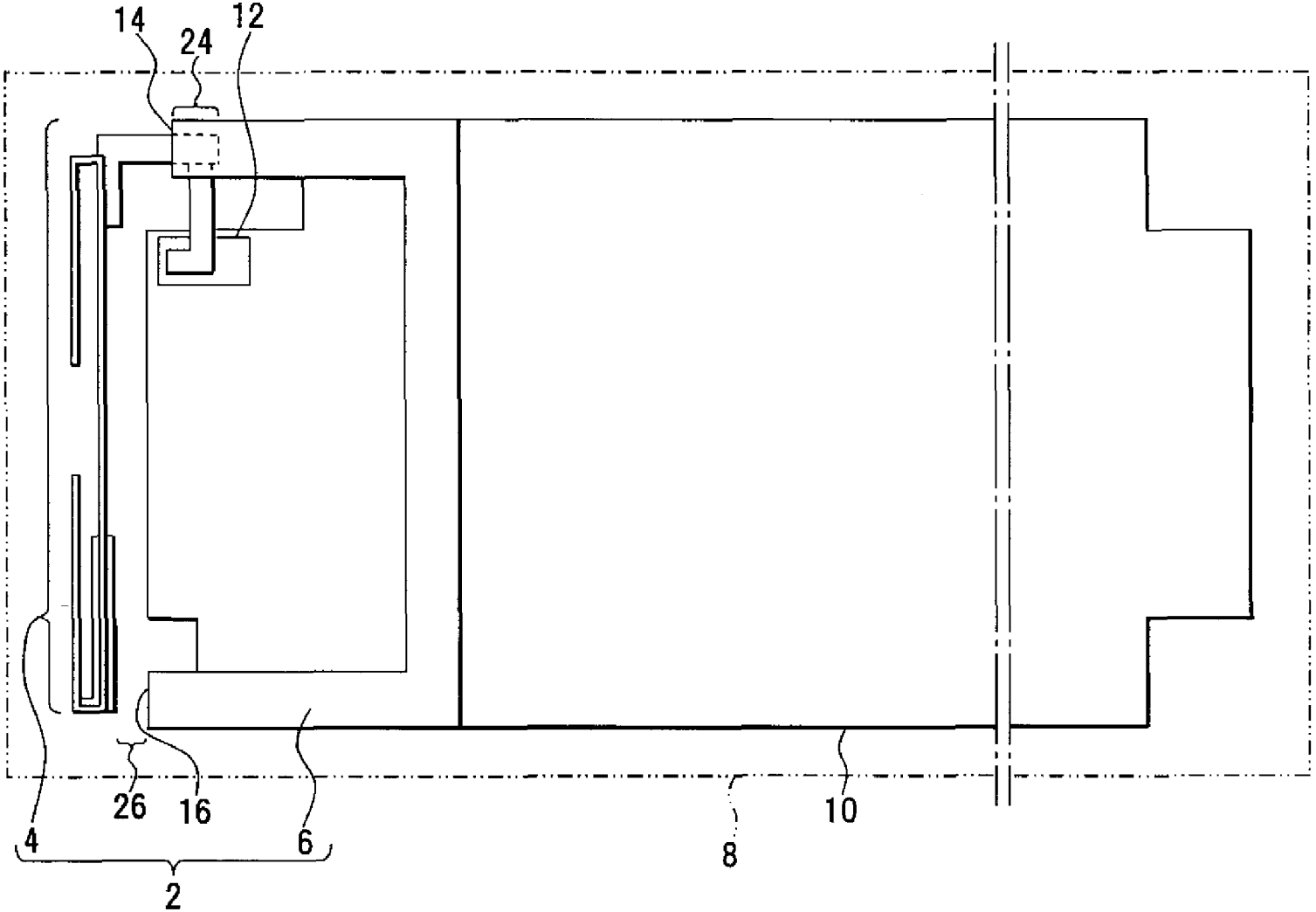
FIG. 6 is a front view of a mounting configuration of the antenna apparatus.
Figure 7:
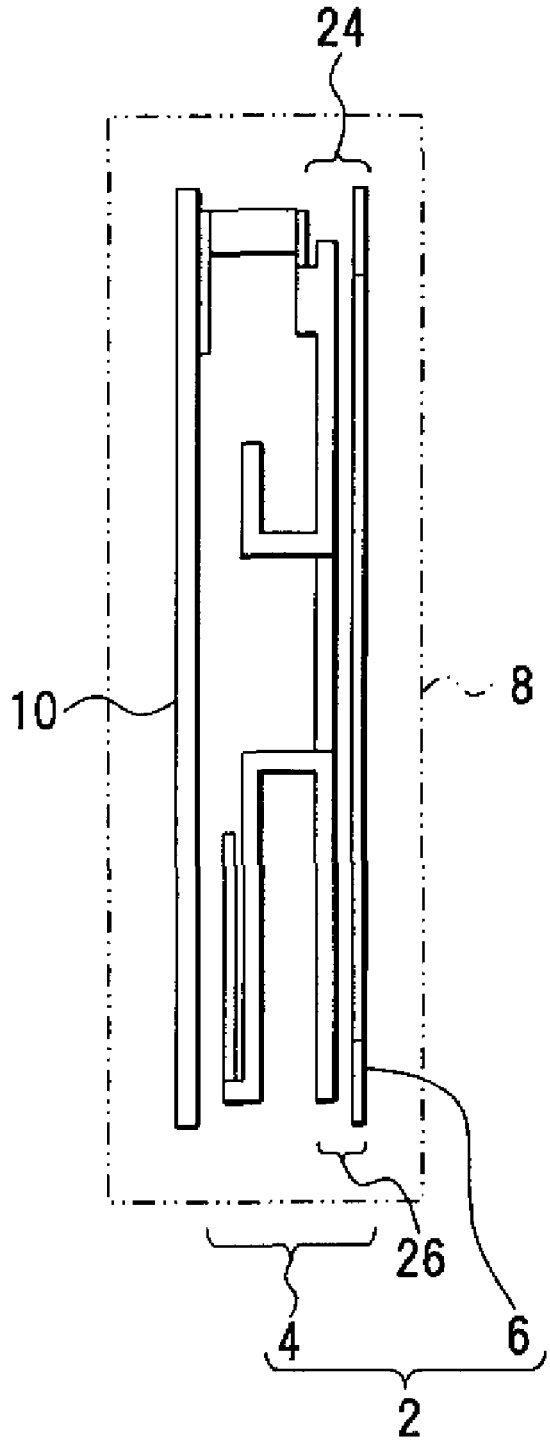
FIG. 7 is a side view of the mounting configuration of the antenna apparatus viewed from the feed element.
Figure 8:
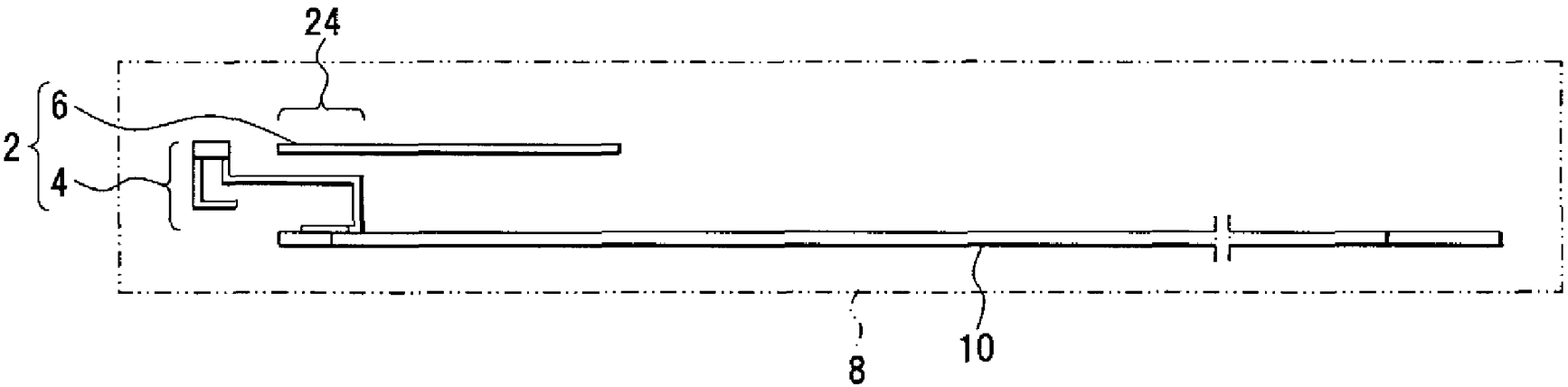
FIG. 8 is a bottom view of the mounting configuration of the antenna apparatus.

A first embodiment of the present invention will be described with reference to FIGS. 1, 2, 3, 4, 5, 6, 7, and 8. FIG. 1 is a perspective view of an outline of an antenna apparatus and a radio communicating apparatus using the antenna apparatus according to a first embodiment; FIG. 2 is an exploded perspective view of the antenna apparatus; FIG. 3 depicts arrangement of a feed element, non-feed element, and printed circuit substrate; FIG. 4 is a perspective view of the feed element and the printed circuit substrate; FIG. 5 is a perspective view of the non-feed element and the printed circuit substrate; FIG. 6 is a front view of a mounting configuration of the antenna apparatus; FIG. 7 is a side view of the mounting configuration of the antenna apparatus viewed from the feed element; and FIG. 8 is a bottom view of the mounting configuration of the antenna apparatus.

An antenna apparatus 2 is a single feed antenna having resonant frequencies in a plurality of frequency bands and includes a feed element 4 that is a single feed antenna, a non-feed element 6 electromagnetically coupled to the feed element 4, as shown in FIG. 1. In this embodiment, the antenna apparatus 2 is built into a housing 8 of a radio communicating apparatus such as a portable phone and is mounted on a mounting member disposed in the housing 8, for example, a printed circuit substrate 10 with a rectangular shape.

The feed element 4 is located outside the printed circuit substrate 10 in the vicinity of a short side of the printed circuit substrate 10 and is connected to a feeding portion 12 established on the printed circuit substrate 10 to configure a single feed dual-band antenna. The feeding portion 12 is a feeding point for the antenna apparatus 2. The non-feed element 6 is located to cover the upper surface of the printed circuit substrate 10 and each open end 14, 16 is located adjacent to the feed element 4 with a slight distance to achieve electromagnetic coupling with the feed element 4. In this case, the open end 14 of the non-feed element 6 is electromagnetically coupled to the feed side of the feed element 4 and the open end 16 is electromagnetically coupled to the open side of the feed element 4.

Showing the antenna apparatus 2 in an exploded view, as shown in FIG. 2, the feed element 4 is disposed with a feed connecting unit 18 and includes first and second antenna element units 20, 22 formed thereon, which have different element length starting from the feed connecting unit 18. The antenna element unit 20 resonates with a first frequency band F1 and the antenna element unit 22 resonates with a second frequency band F2. The printed circuit substrate 10 includes the feeding portion 12 connected to the feed connecting unit 18 of the feed element 4, and the non-feed element 6 is located to cover the upper surface of the printed circuit substrate 10.

Showing the antenna apparatus 2 in a schematic view, as shown in FIG. 3, the feed connecting unit 18 is connected to the feeding portion 12 of the printed circuit substrate 10, and the feed element 4 is drawn out to the side surface of the printed circuit substrate 10 through the feed connecting unit 18. The antenna element unit 20 resonating with the frequency band F1 and the antenna element unit 22 resonating with the frequency band F2 are located at a side portion of the printed circuit substrate 10. The open ends 14, 16 of the non-feed element 6 located to cover the upper surface of the printed circuit substrate 10 are electromagnetically coupled to the feed element 4, and the electromagnetic coupling is achieved by a feed-side coupling portion 24 on the feed side of the feed element 4 and by an open-side coupling portion 26 on the open side of the feed element 4.

In the antenna apparatus 2, the feed element 4 is located in the vicinity of the printed circuit substrate 10 and is folded and downsized, and in this embodiment, as shown in FIG. 4, the feed element 4 is set to a height W11 in the thickness direction of the printed circuit substrate 10, a width W12 corresponding to a width W0 of the printed circuit substrate 10 (in this case, W12≦W0), and a length W13 corresponding to the longitudinal direction of the printed circuit substrate 10. The height W11 can be housed in a housing space established in the housing 8 and is set to be equal to or less than heights of mounted circuit parts, etc., of the printed circuit substrate 10. The width W12 can be housed in the housing space established in the housing 8 and is set to be equal to or less than the width W0 of the printed circuit substrate 10. That is, the feed element 4 of the antenna apparatus 2 has a size and a shape that can be disposed in a space of a rectangular parallelepiped formed with the height W11, the width W12, and the length W13.

With such restriction on the height W11 and the width W12, to realize resonance in the frequency bands F1 and F2, necessary antenna lengths L1, L2 are established with a folded configuration in the feed element 4. Therefore, the feed connecting unit 18 is a belt-shaped bending body made of a conductive material integral with the antenna element units 20 and 22 and includes element portions 181, 182, 183, and 184. The element portion 181 is a connecting portion connected to the feeding portion 12. The element portion 183 is folded back from the element portion 181 through the element portion 182 and is L-shaped to locate the element portion 184 toward inside of the printed circuit substrate 10. Assuming that the height of the element portion 182, the height of the element portion 184, and the width of the antenna element units 20 and 22 are H1, H2, and H3, respectively, H1+H2++H3=W11 is established by summing the heights and the width.

The antenna element unit 20 is extended parallel in the width direction of the printed circuit substrate 10 from the element portion 184 of the feed connecting unit 18 and includes element portions 201, 202, 203, 204, 205, 206, and 207 to ensure the element length L1 necessary for the resonance in the frequency band F1 within a width narrower than the width W0. The element portion 201 is the longest linear portion extended in the width direction of the printed circuit substrate 10; the element portion 202 is bent from the element portion 201 in a direction away from the printed circuit substrate 10; and the element portion 203 is folded back from the element portion 202 to become parallel to the element portion 201. The element portion 204 is bent from the element portion 203 to form an L-shape, and the length thereof is set equal to a height obtained by adding the height H2 of the element portion 184 of the feed connecting unit 18 and the width H3 of the antenna element unit 20. The element portion 205 is bent and extended from the element portion 204 in the direction of the element portion 202 to form an L-shape and is located parallel to the element portion 201, and the element portion 206 is formed in the vicinity of the element portion 202. The element portion 206 is an L-shaped bending portion configuring a spacing portion for disposing the element portion 207 within a length equivalent to the element portion 202. The element portion 207 is folded back from the element portion 206 to form an L-shape and is located parallel to the element portions 201, 203, and 205.

The antenna element unit 22 is formed from the element portion 184 of the feed connecting unit 18 in the direction opposite to the element portion 201 and includes element portions 221, 222, 223, 224, and 225 to establish the element length L2 necessary for the resonance in the frequency band F2 within the width W0. The element portion 221 is formed from the element portion 184 colinearly with the element portion 201; the element portion 222 is formed from the element portion 221 to become parallel to and have same width as the element portion 202; the element portion 223 is folded from the element portion 222 toward the element portions 201, 221 and located parallel to the element portions 201, 221; the element portion 224 forms an L-shape to become parallel to the element portion 204 from the element portion 223; and the element portion 225 is folded back from the element portion 224 toward the element portion 184 and is located parallel to the element portion 223.

The non-feed element 6 is disposed over the upper surface of the printed circuit substrate 10 with a distance D from the printed circuit substrate 10 and includes element portions 601, 602, and 603 in this embodiment as shown in FIG. 5. The element portion 601 is set to a width W21 corresponding to the width W0 (in this case, W21≦W0); the element portion 602 is set to a length W22; and the element portion 603 is set to a length W23. The element potions 601, 602, and 603 are made of the same conductive material as the feed element 4; the element portion 601 is a flat linear member and is located parallel to the element portions 201, 221 of the feed element 4 and the printed circuit substrate 10; and the element portions 602 and 603 are bent from the element portion 601 at a right angle to form a C-shape and are located parallel to each other. The open ends 14 and 16 are formed on the element portions 602 and 603 as above, and the open end 14 is located to the element portions 184, 221 (FIG. 4) and the element portion 603 is located closer to the element portion 201 side to achieve the electro magnetic coupling between the feed element 4 and the open ends 14 and 16.

In the antenna apparatus 2, as shown in FIGS. 6, 7, and 8, the feed element 4 is located outside the surface of the printed circuit substrate 10; the non-feed element 6 is located within the surface of the printed circuit substrate 10; and the electromagnetic coupling is achieved in the feed-side coupling portion 24 and the open-side coupling portion 26 between the feed element 4 fed from the feeding portion 12 of the printed circuit substrate 10 and the non-feed element 6.

With such a structure, multiple resonance can be acquired from the antenna element units 20, 22 of the feed element 4; a resonant frequency f1 in the frequency band F1 can be obtained from the antenna element unit 20; a resonant frequency f2 in the frequency band F2 can be obtained from the antenna element unit 22; and a resonant frequency f3 in the frequency band F3 can further be acquired by adding the non-feed element 6. In this case, the resonant frequencies f1, f2, and f3 are f1<f3<f2 due to the magnitude correlation of antenna lengths.

Figure 9:
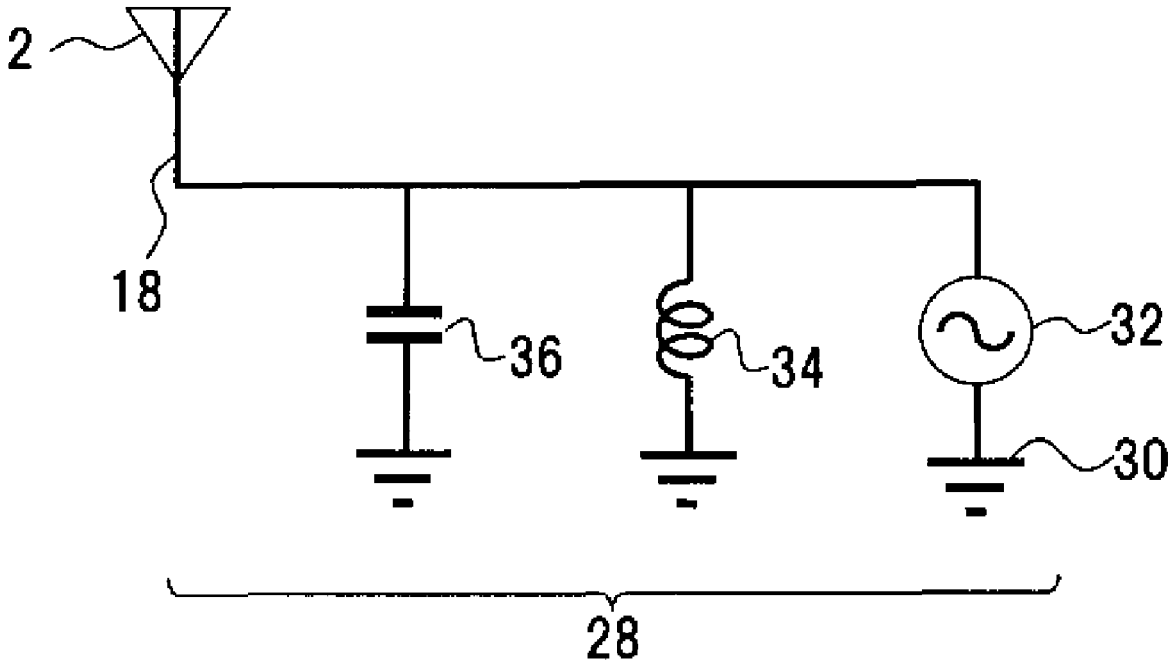
FIG. 9 is a circuit diagram of an example of a matching circuit.

A matching circuit of the antenna apparatus 2 will be described with reference to FIG. 9. FIG. 9 is a circuit diagram of an example of a matching circuit.

In this matching circuit 28, a signal source 32 is connected between the feed connecting unit 18 of the antenna apparatus 2 and a ground point 30, and an inductor 34 and a capacitor 36 are also connected. With this matching circuit 28, the matching is performed such that a voltage standing wave ratio (VSWR) is minimized, and the optimum voltage standing wave ratio can be acquired for the resonant frequencies f1, f2, and f3 of the antenna apparatus 2.

Figure 10:
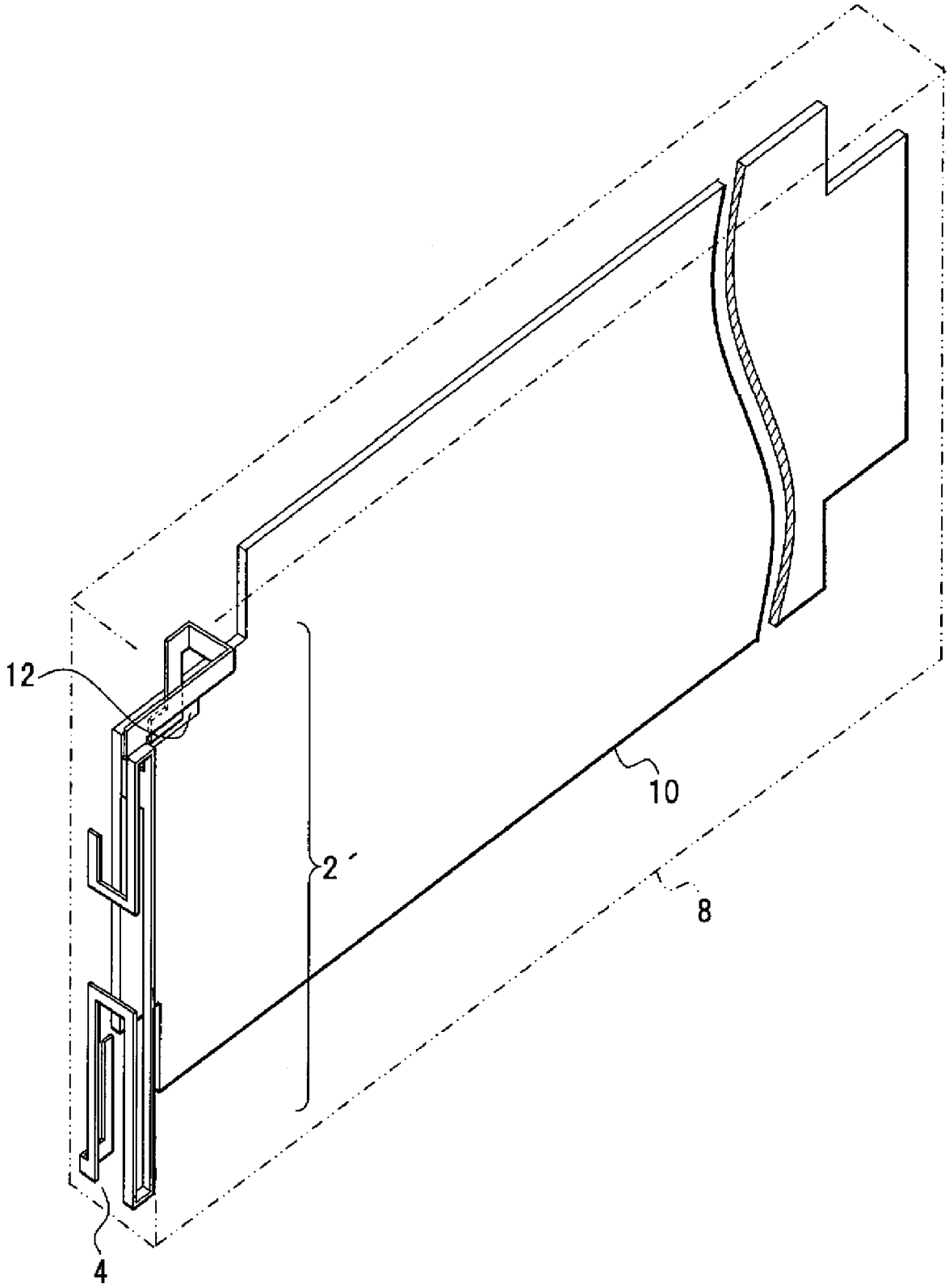
FIG. 10 is a perspective view of an antenna apparatus without the non-feed element.
Figure 11:
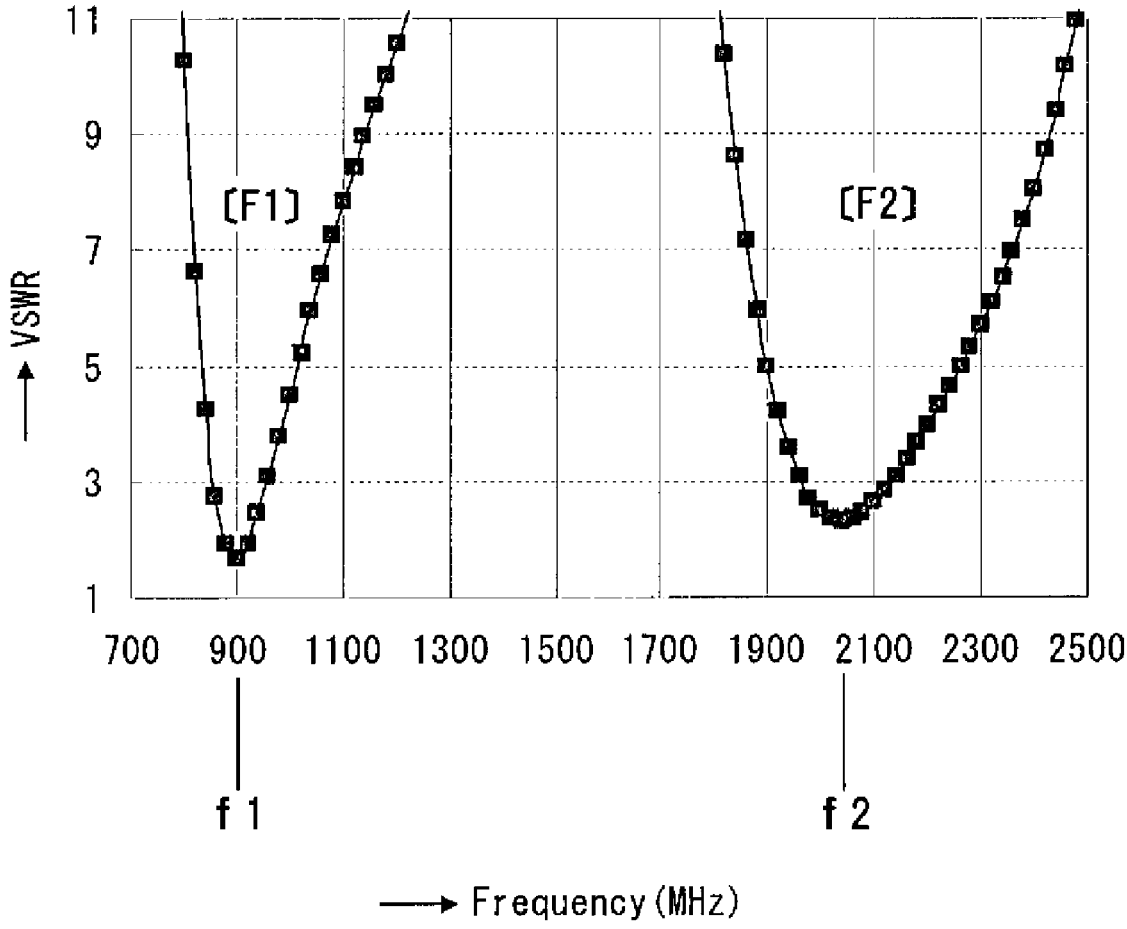
FIG. 11 depicts VSWR characteristics.
Figure 12:
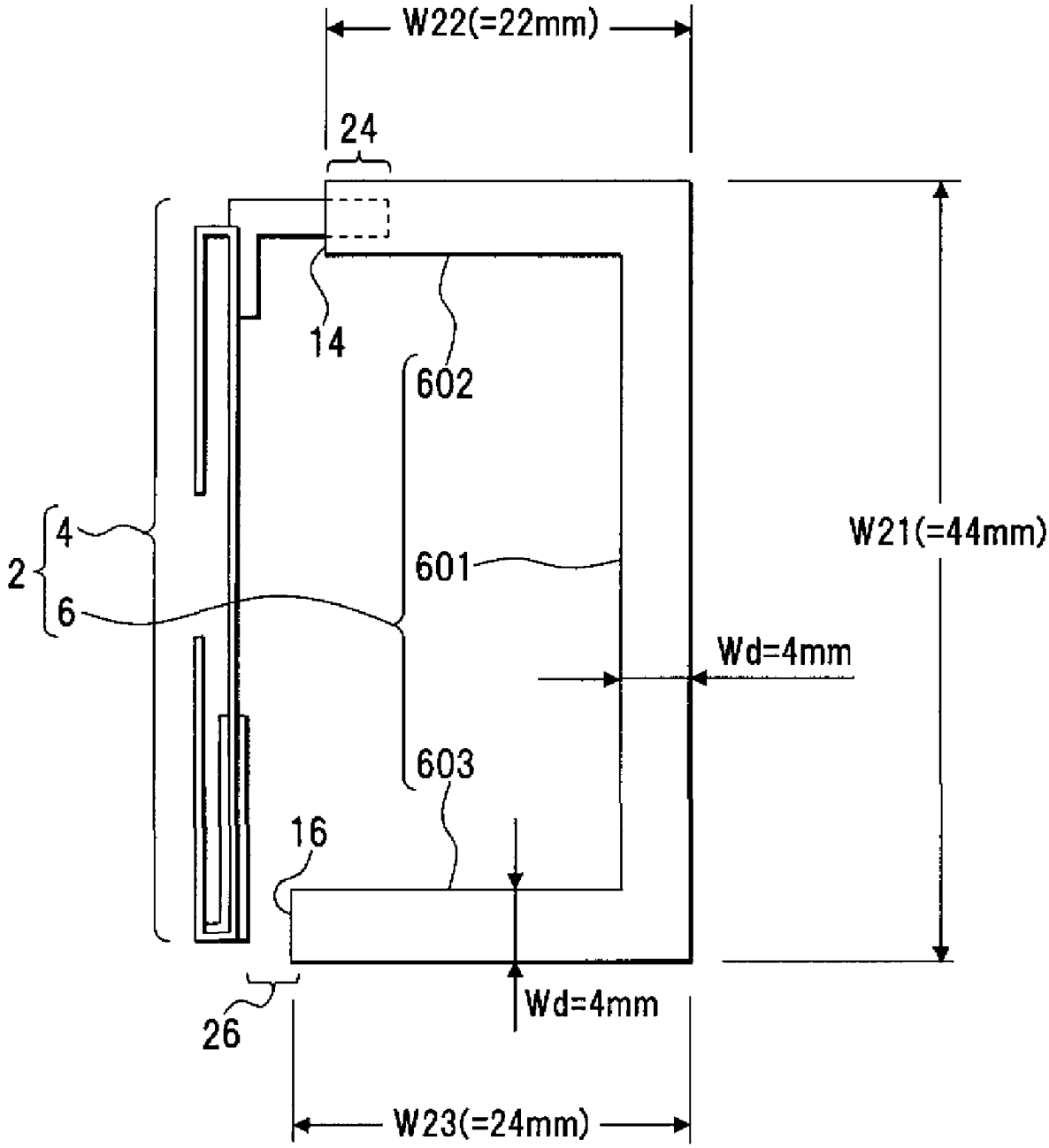
FIG. 12 depicts a configuration example of the antenna apparatus.
Figure 13:
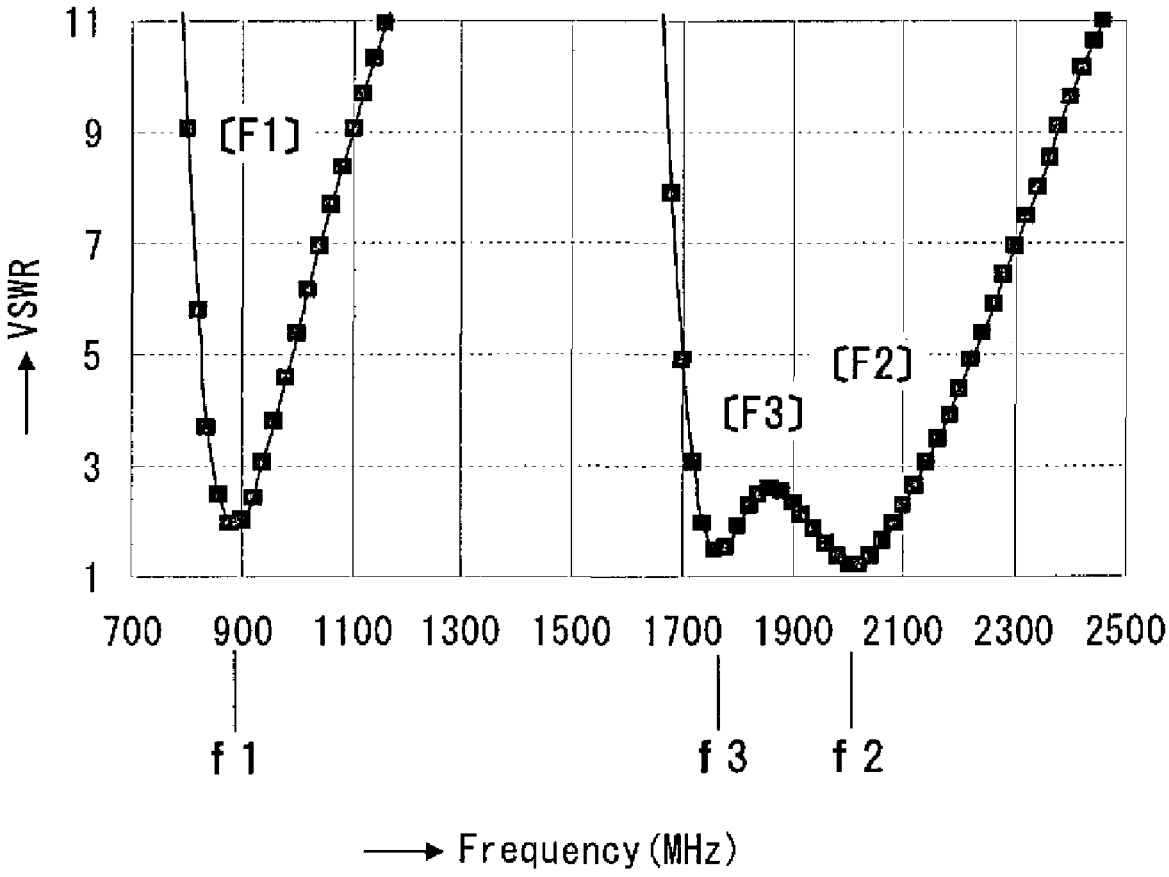
FIG. 13 depicts VSWR characteristics.

The VSWR characteristics of the antenna apparatus 2 will be described with reference to FIGS. 10, 11, 12, and 13. FIG. 10 is a perspective view of an antenna apparatus without the non-feed element; FIG. 11 depicts the VSWR characteristics thereof; FIG. 12 depicts a configuration example of the antenna apparatus; and FIG. 13 depicts the VSWR characteristics thereof. In FIGS. 10 and 12, the same reference numerals are added to the same portions as FIGS. 1, 2, and 3.

For comparison with the antenna apparatus 2, an antenna apparatus 2 has the configuration of the antenna apparatus 2 (FIG. 1) except the non-feed element 6 as shown in FIG. 10. The antenna apparatus 2 without the non-feed element 6 configures a single feed dual-band antenna as described above. In this antenna apparatus 2, as shown in FIG. 11, resonance characteristics are acquired from two frequency bands F1, F2. In this case, the matching circuit 28 is used.

On the other hand, in the antenna apparatus 2, as shown in FIG. 12, the non-feed element 6 is set to acquire resonance in the frequency band F3, for example, 1.7 [GHz], and the length L3 of the non-feed element 6 is set to L3=2/λ for the wavelength λ of 1.7 [GHz]. The non-feed element 6 is located with the open end 14 closer to the feed side of the feed element 4 and with the open end 16 closer to the open side of the non-feed element 6; the size thereof is set to W21=44 [mm], W22=22 [mm], and W23=24 [mm]; and the width of each element portion 601, 602, and 603 of the non-feed element 6 is set to Wd=4 [mm].

In this antenna apparatus 2, as shown in FIG. 13, the characteristics of the frequency band F3 of the non-feed element 6 is added to the VSWR characteristics of the antenna apparatus 2, and the resonant frequency f1 in the frequency band F1, the resonant frequency f2 in the frequency band F2, and the resonant frequency f3 in the frequency band F3 can be acquired.

In this way, multifrequency resonance can be realized along with the downsizing of the antenna apparatus 2 capable of multifrequency resonance, and this antenna apparatus 2 can be disposed in a small disposition space such as a flat disposition space.

Figure 14A:
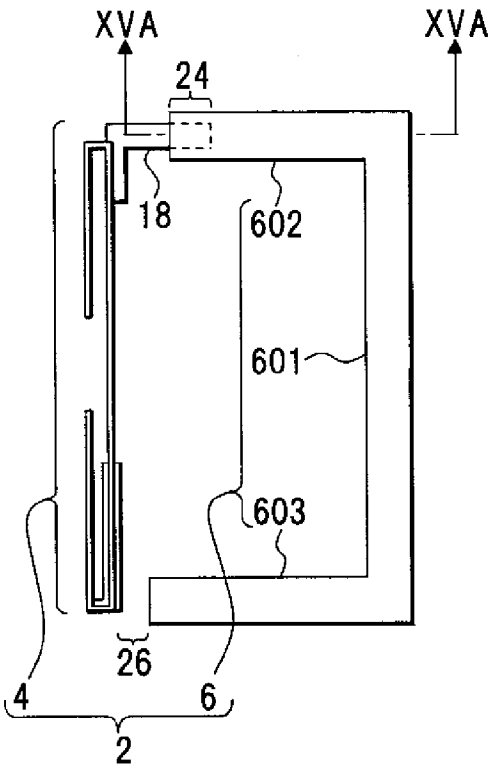
FIGS. 14A to 14C depict coupling adjustment of a feed-side coupling portion of the non-feed element.
Figure 14B:
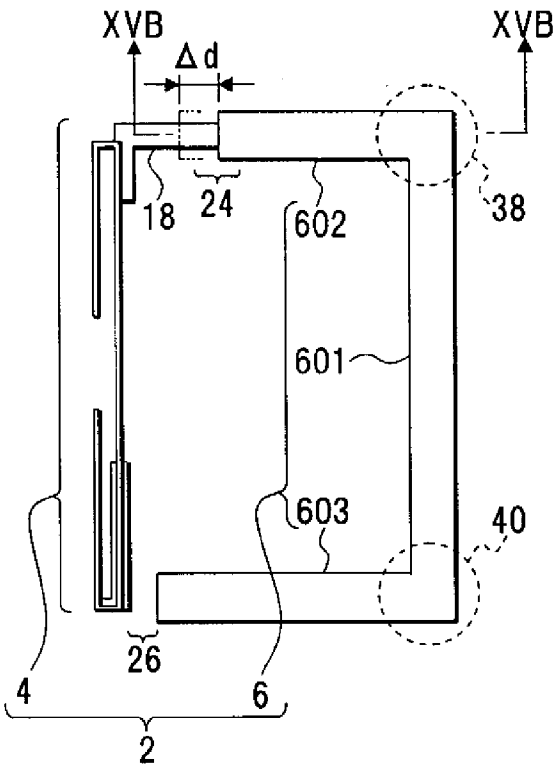
Figure 14C:
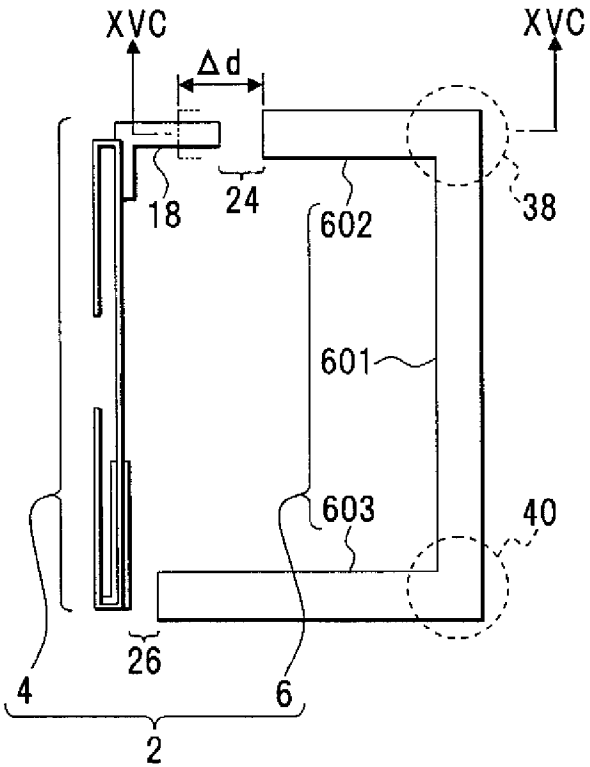
Figure 15A:
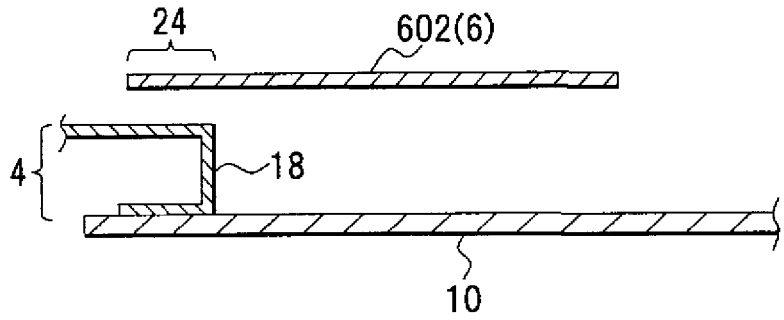
FIGS. 15A to 15C are sectional views corresponding to the coupling adjustment.
Figure 15B:
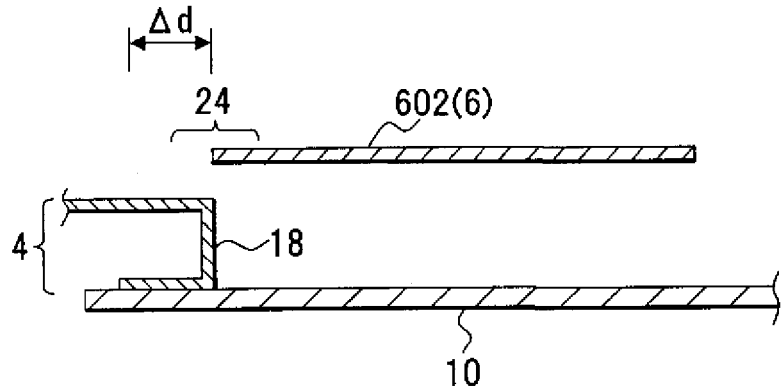
Figure 15C:
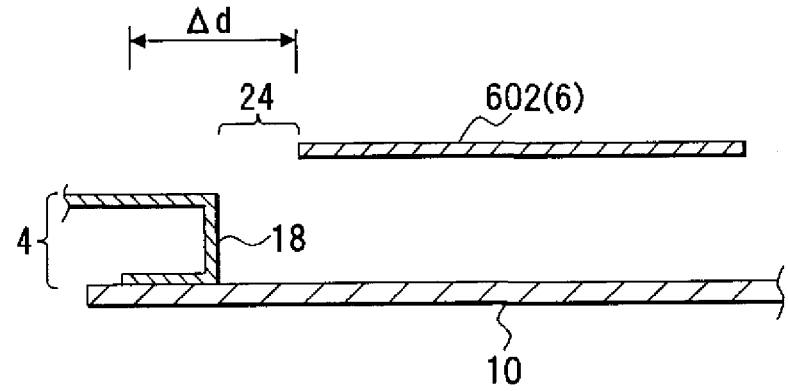
Figure 16:
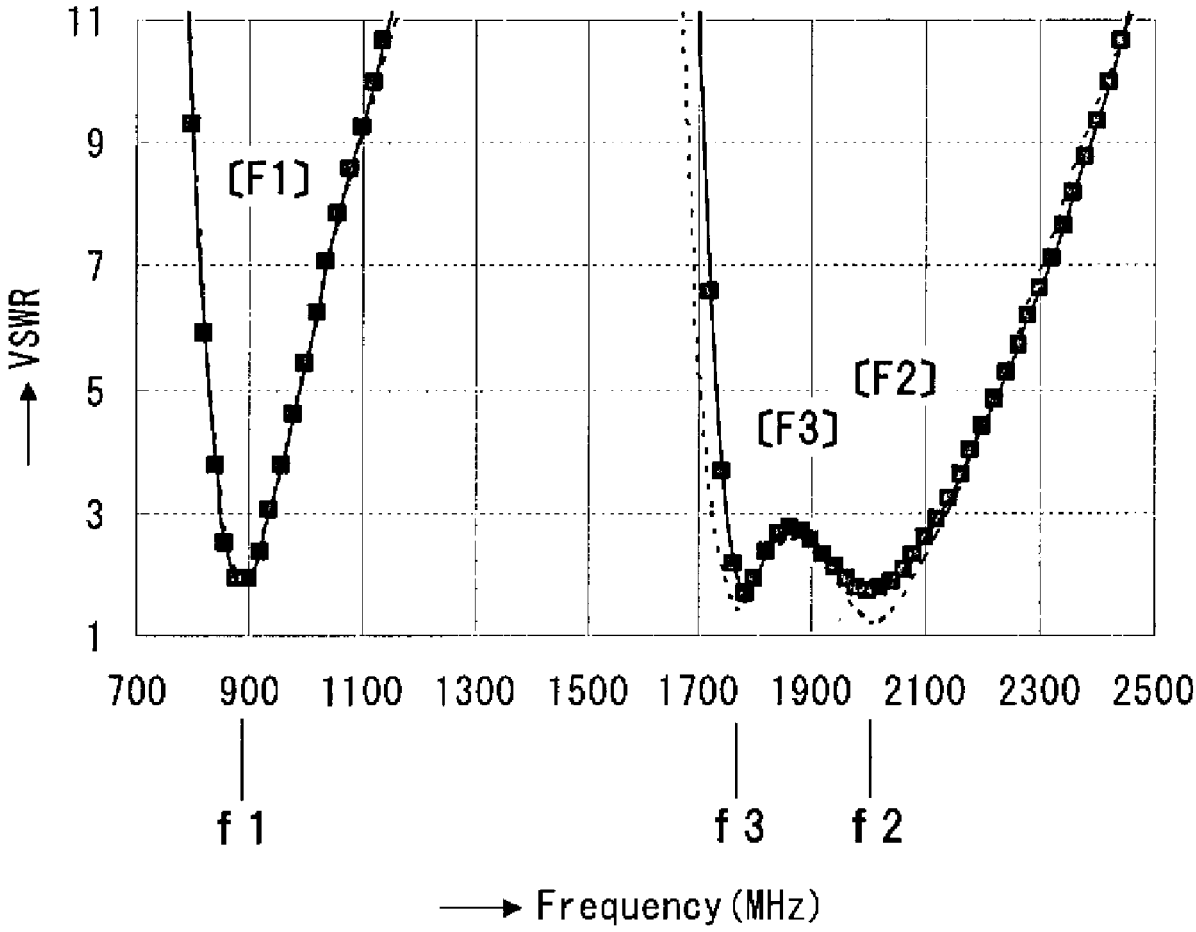
FIG. 16 depicts VSWR characteristics.
Figure 17:
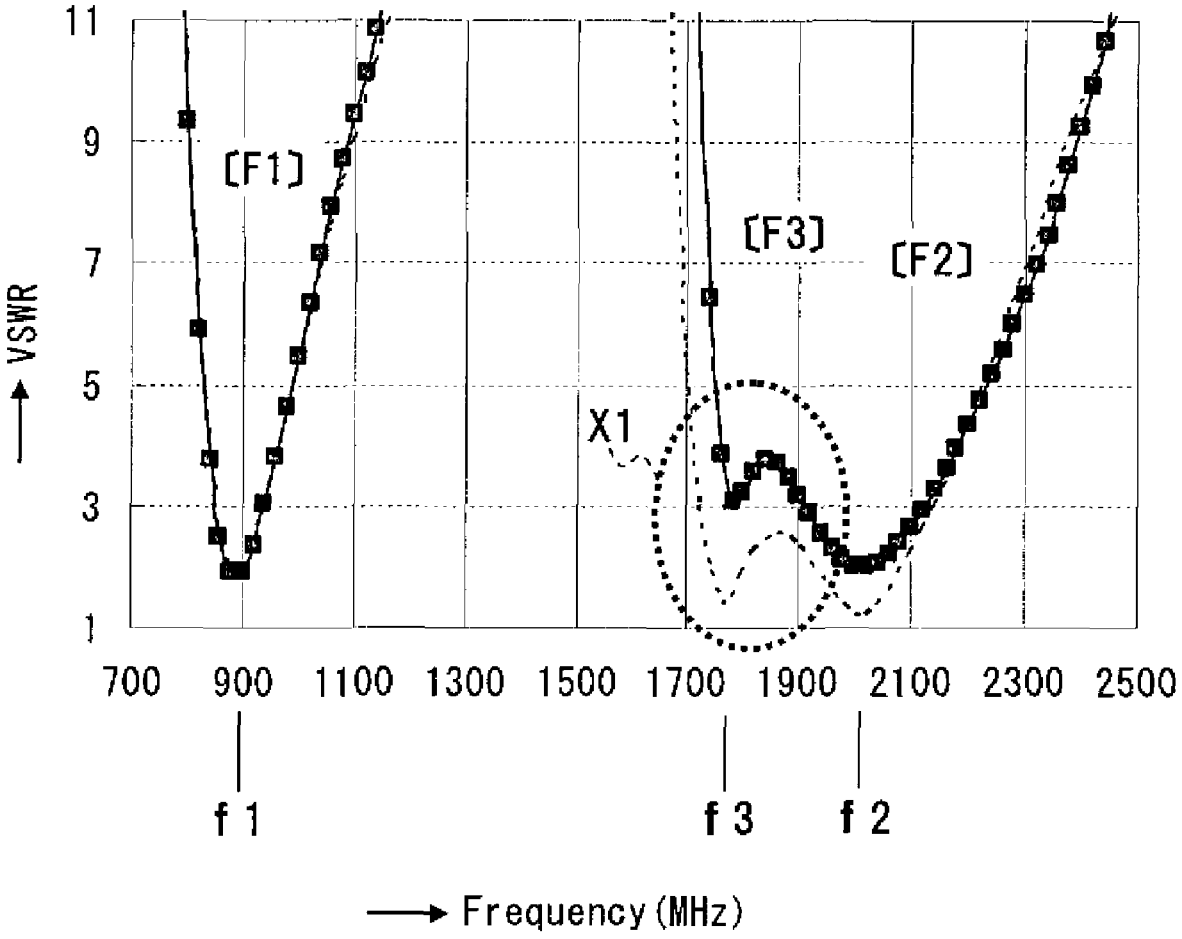
FIG. 17 depicts VSWR characteristics.
Figure 18A:
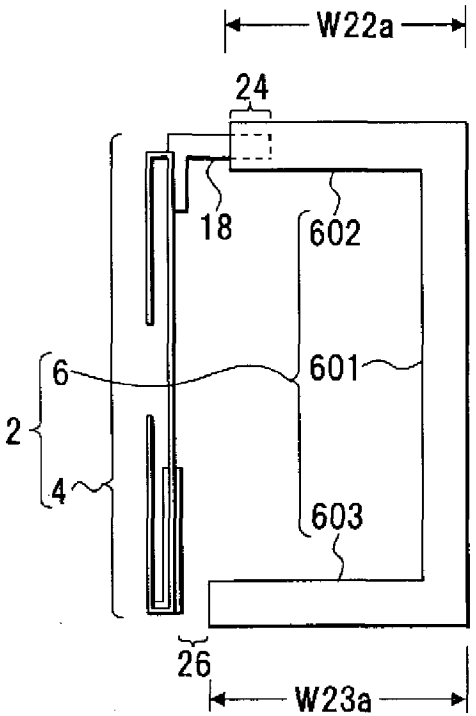
FIGS. 18A to 18C depict coupling adjustment of an open-side coupling portion of the non-feed element.
Figure 18B:
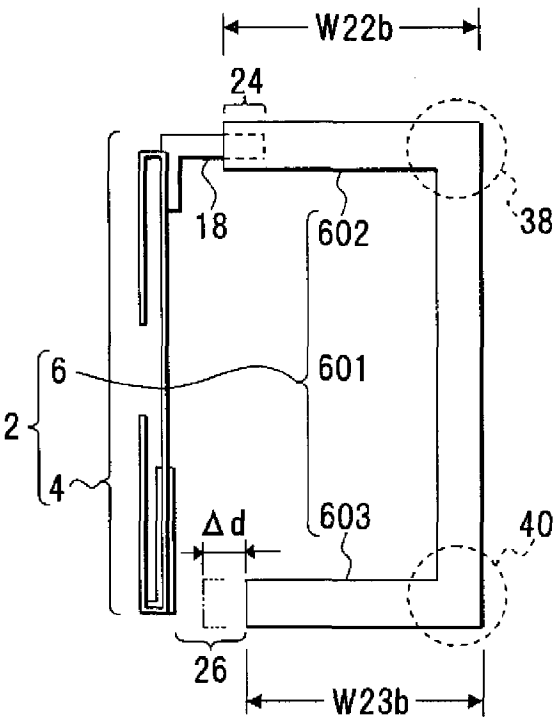
Figure 18C:
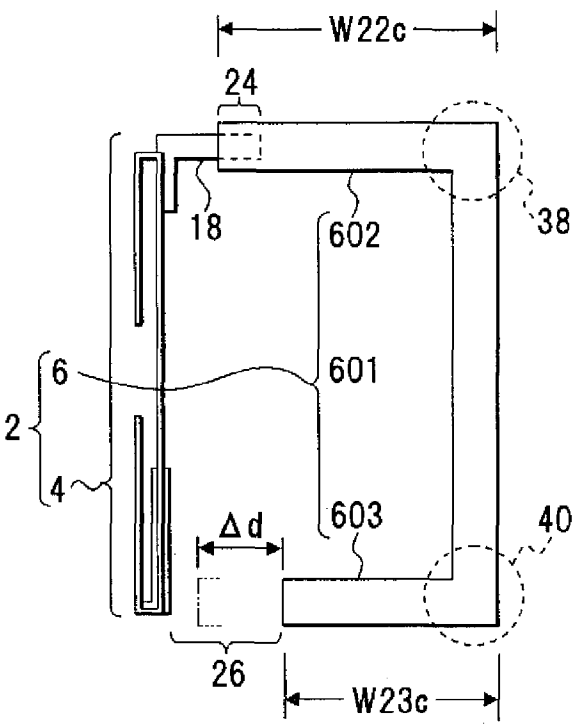
Figure 19:
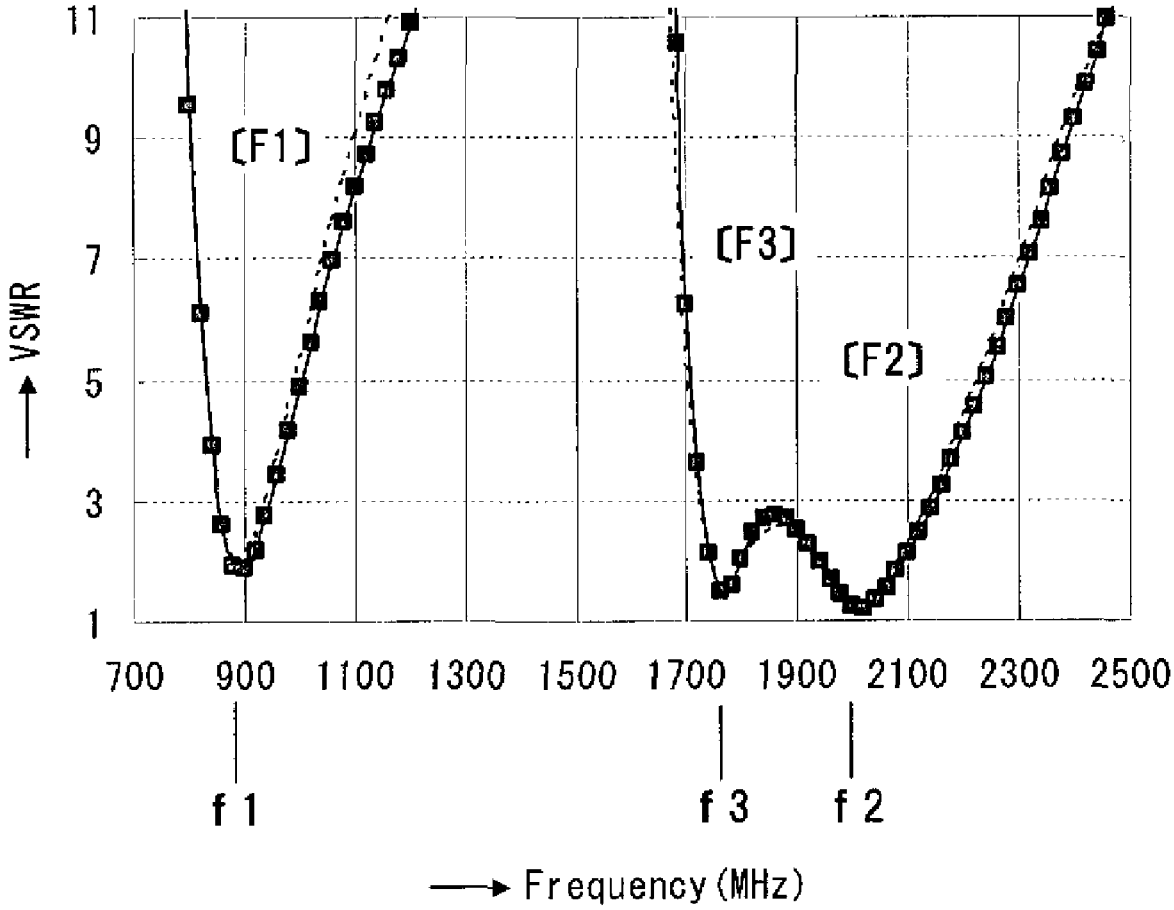
FIG. 19 depicts VSWR characteristics.
Figure 20:
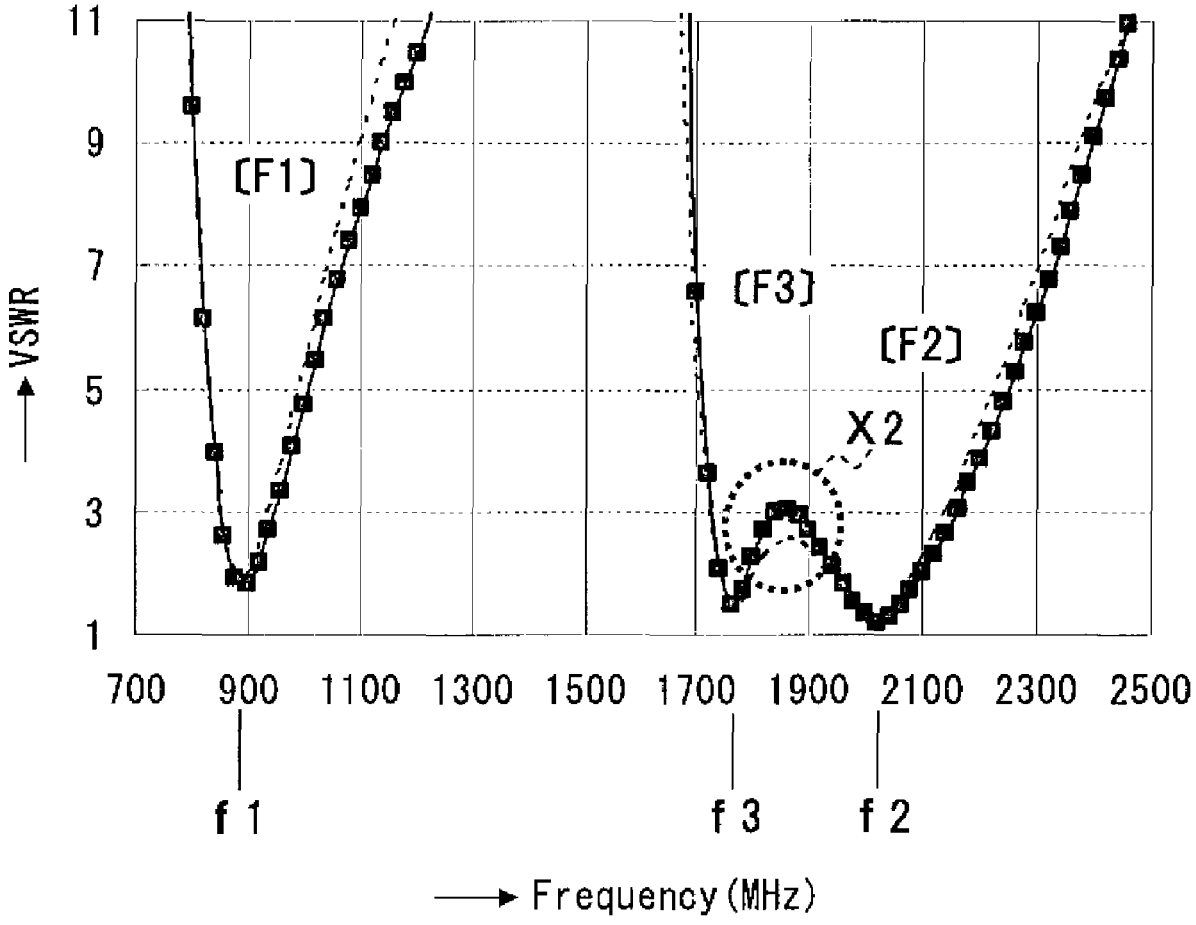
FIG. 20 depicts VSWR characteristics.
Figure 21A:
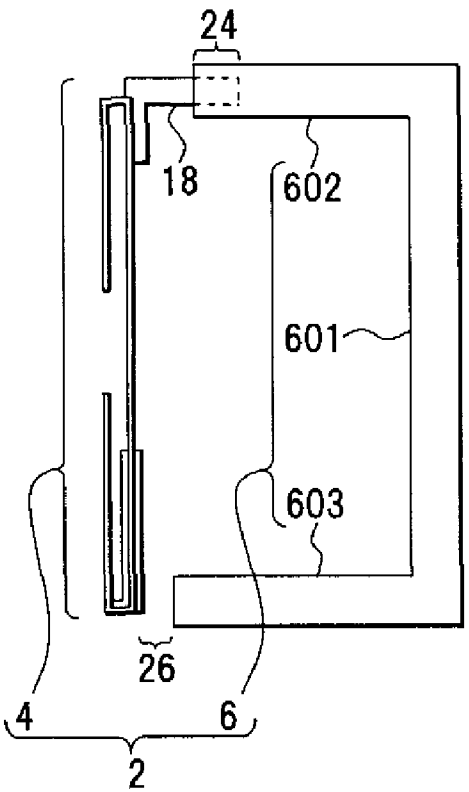
FIGS. 21A to 21C depict another coupling adjustment of the feed-side coupling portion of the non-feed element.
Figure 21B:
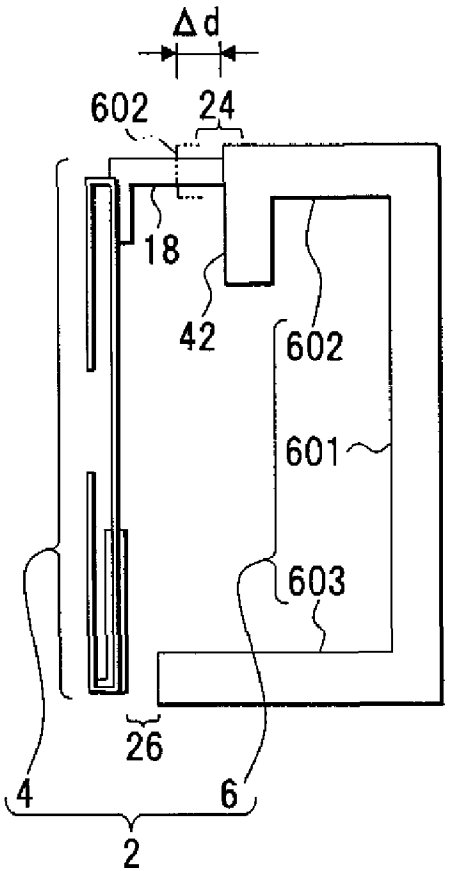
Figure 21C:
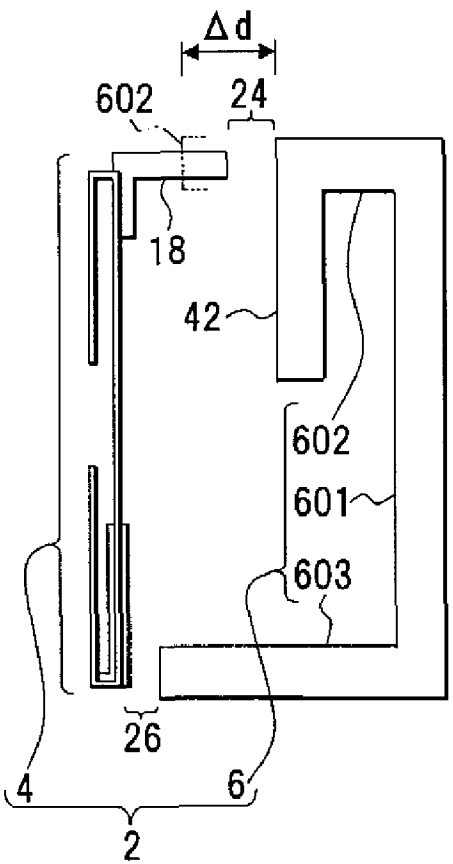
Figure 22:
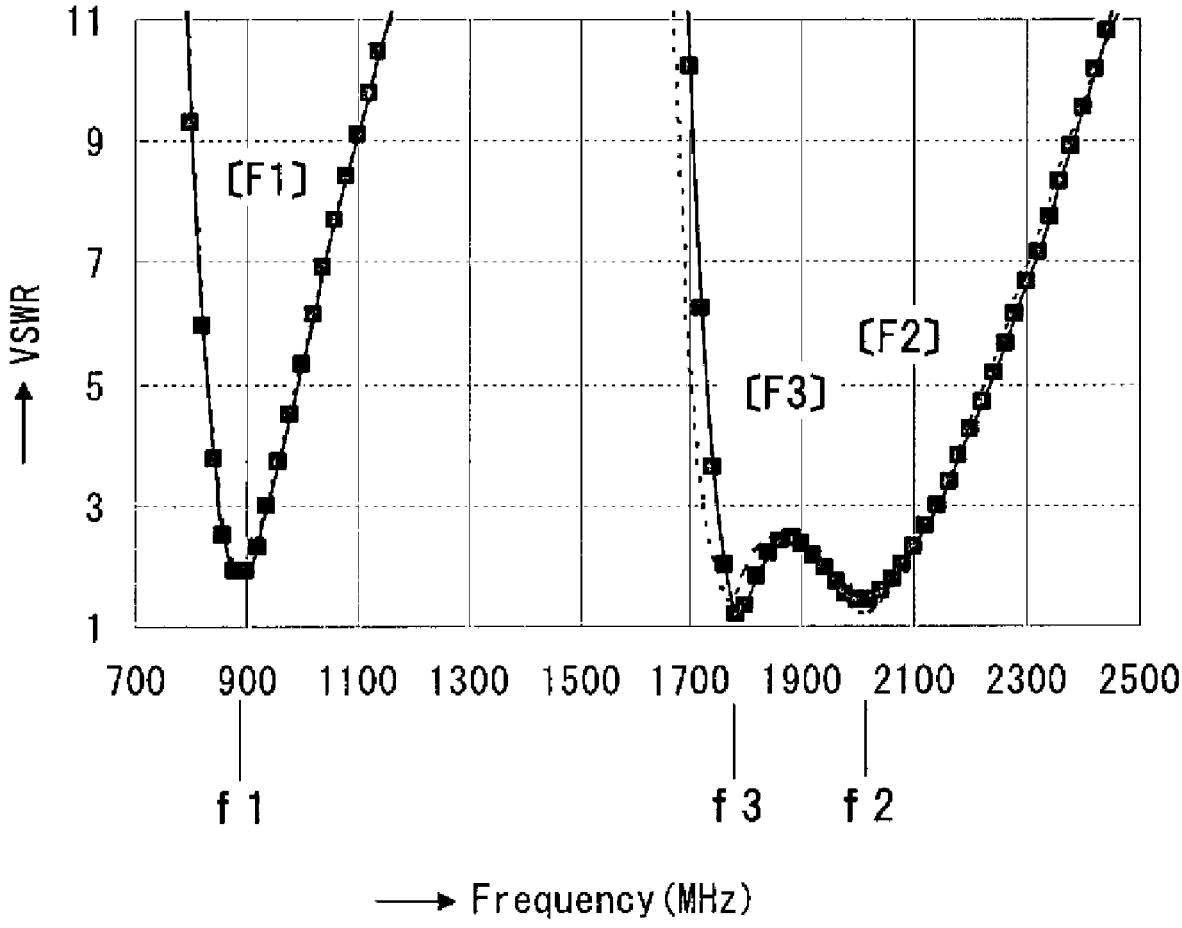
FIG. 22 depicts VSWR characteristics.
Figure 23:
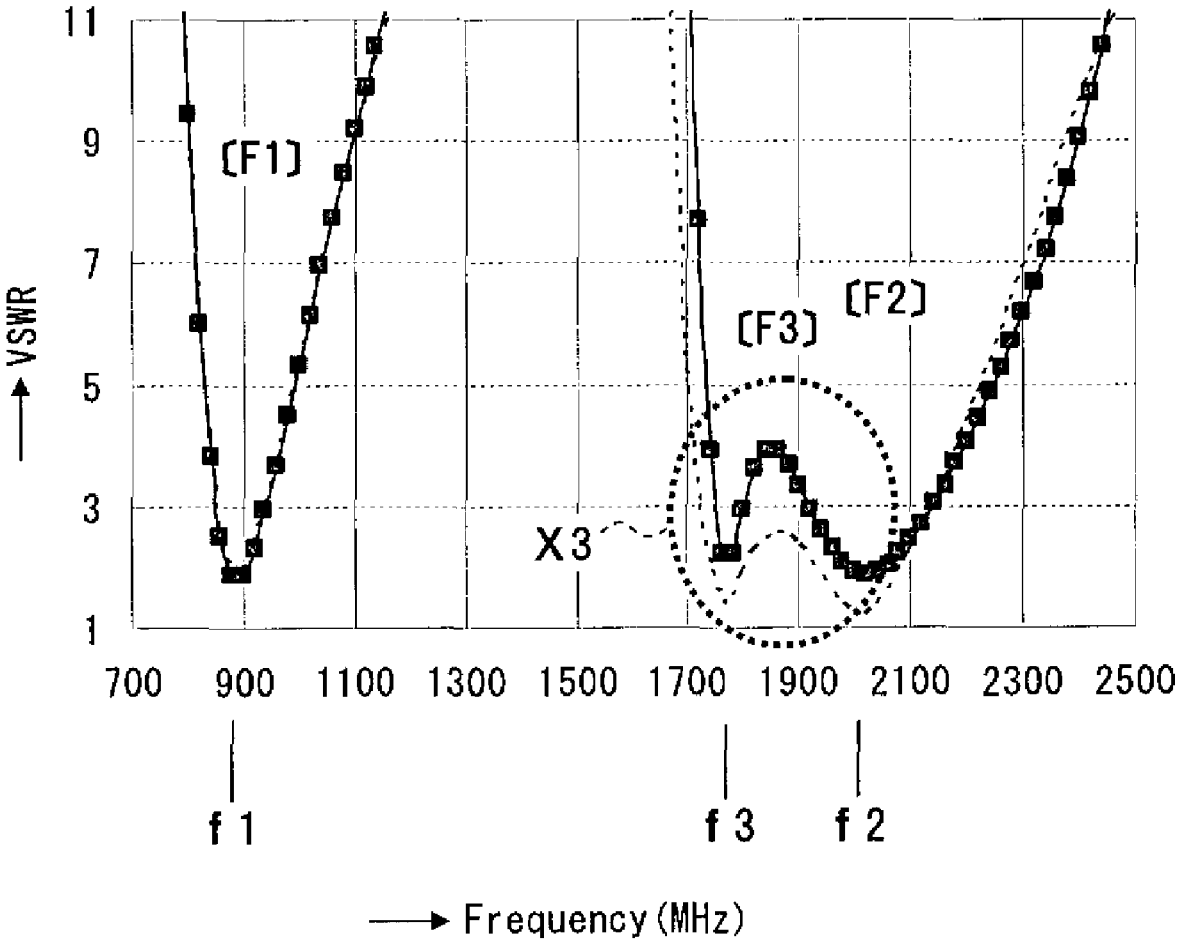
FIG. 23 depicts VSWR characteristics.
Figure 24A:
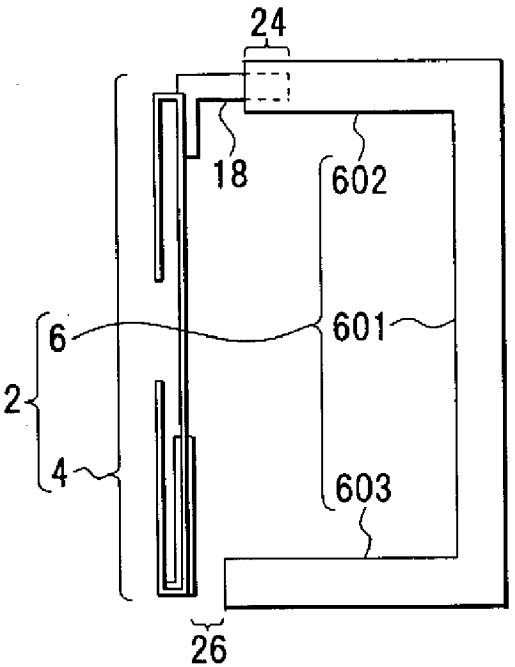
FIGS. 24A to 24C depict another coupling adjustment of the open-side coupling portion of the non-feed element.
Figure 24B:
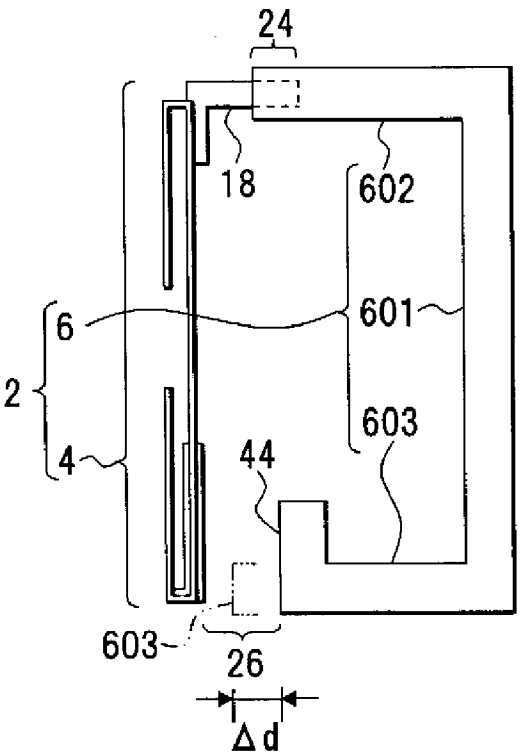
Figure 24C:
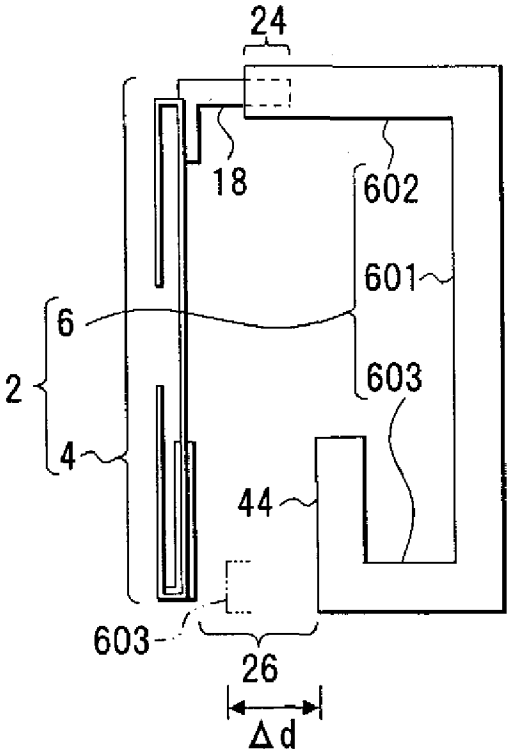
Figure 25:
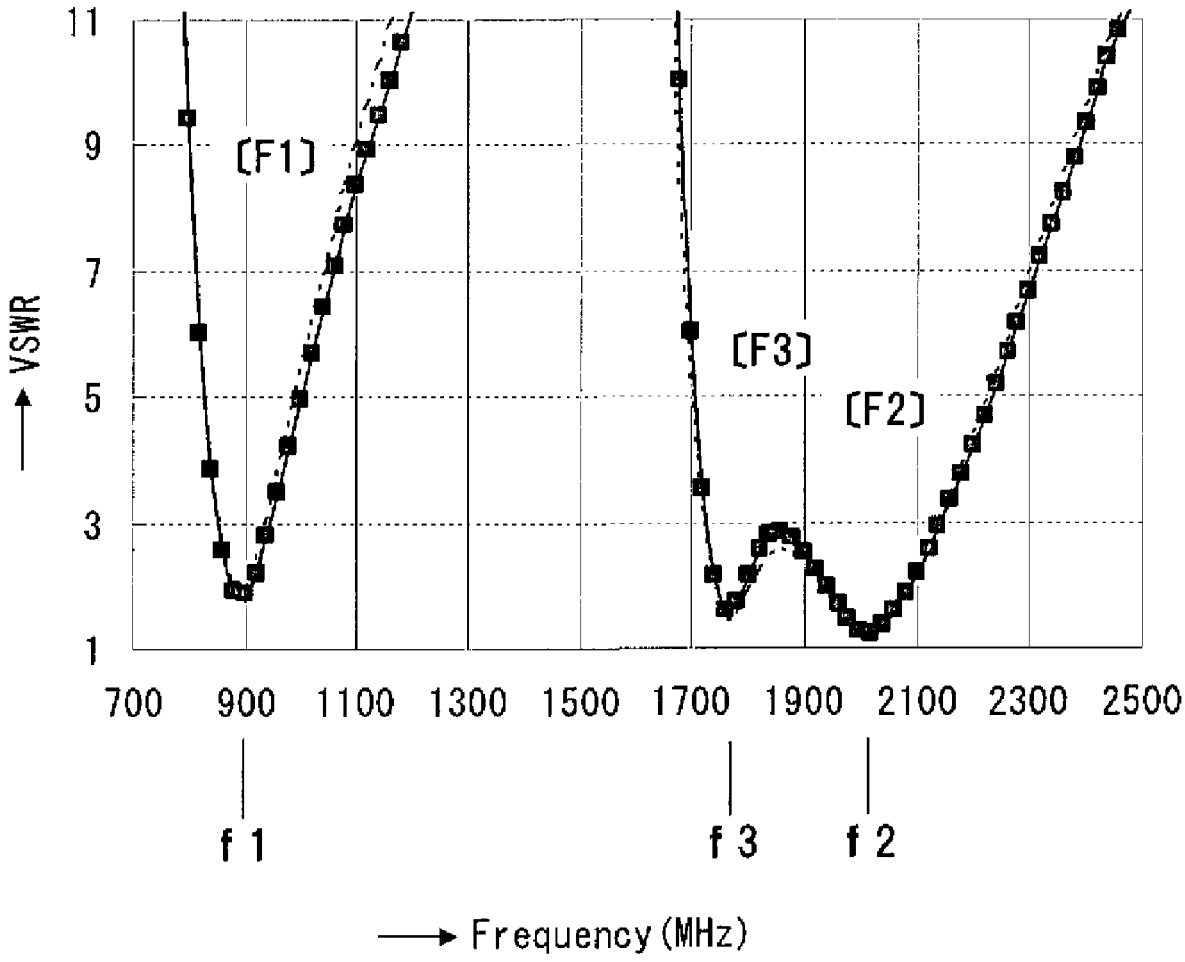
FIG. 25 depicts VSWR characteristics.
Figure 26:
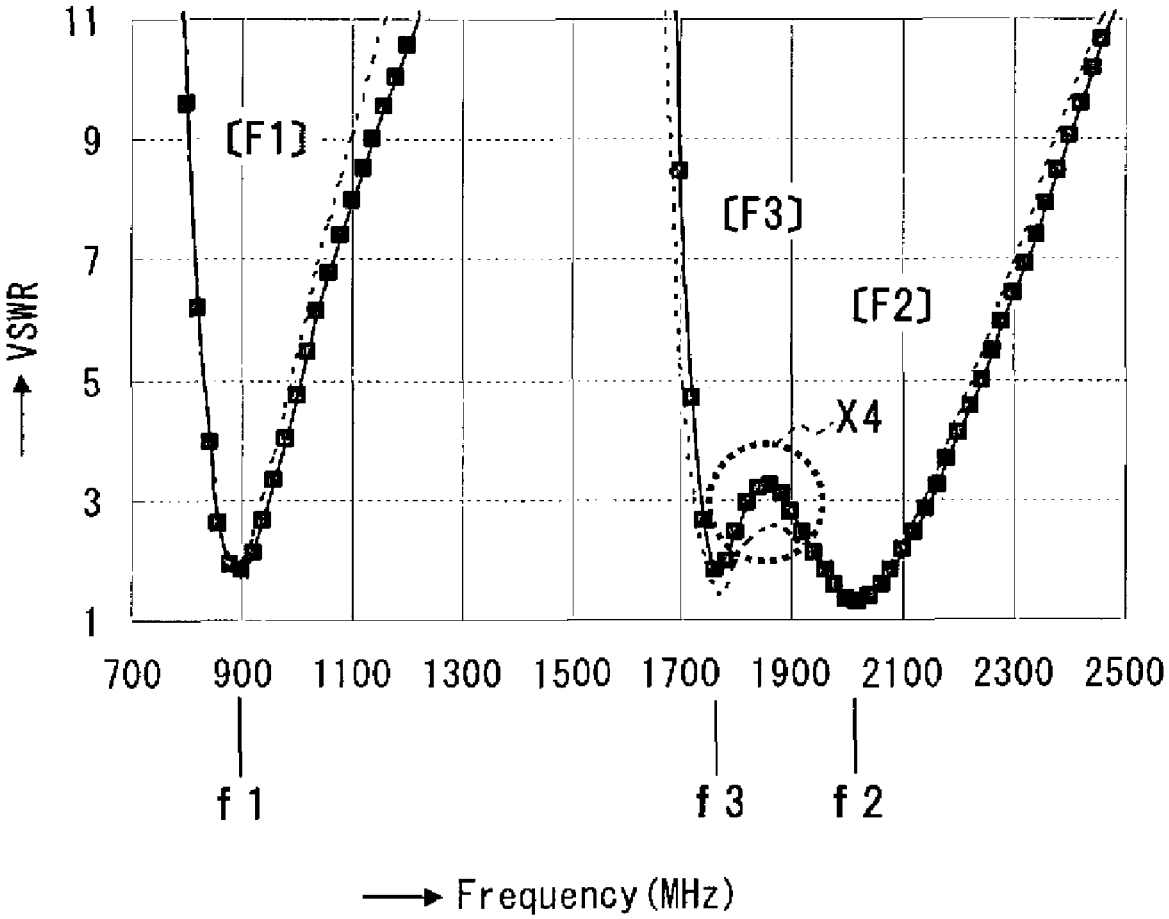
FIG. 26 depicts VSWR characteristics.

The adjustment of the characteristics of the antenna apparatus 2 will be described with reference to FIGS. 14A to 26. FIGS. 14A to 14C depict coupling adjustment of the feed-side coupling portion of the non-feed element; FIGS. 15A to 15C are sectional views corresponding to the coupling adjustment; FIGS. 16 and 17 depict VSWR characteristics; FIGS. 18A to 18C depict coupling adjustment of the open-side coupling portion of the non-feed element; FIGS. 19 and 20 depict VSWR characteristics; FIGS. 21A to 21C depict another coupling adjustment of the feed-side coupling portion of the non-feed element; FIGS. 22 and 23 depict VSWR characteristics; FIGS. 24A to 24C depict another coupling adjustment of the open-side coupling portion of the non-feed element; and FIGS. 25 and 26 depict VSWR characteristics.

(1) Coupling Adjustment of Feed-Side Coupling Portion 24 (Mainly, Adjustment of Distance Δd)

In the antenna apparatus 2, as shown in FIG. 14A and FIG. 15A, a default shape and a default position of the non-feed element 6 are defined as a shape and a position when the non-feed element 6 is located at a position where the feed connecting unit 18 of the feed element 4 is overlapped with the element portion 602 and where the element portion 603 is in the vicinity of the feed element 4, and it is defined as reference values that the coupling strengths of the feed-side coupling portion 24 and the open-side coupling portion 26 in this case. FIG. 15A is an XVA-XVA sectional view of FIG. 14A.

On the other hand, as shown in FIG. 14B and FIG. 15B, the element portion 602 is moved away from the default position by a distance Δd without changing the length thereof, and this distance Δd is set to 4 [mm], for example. FIG. 15B is an XVB-XVB sectional view of FIG. 14B. In this case, correspondingly to the movement of the element portion 602 by the distance Δd, the element portion 603 is elongated by that distance so as not to change the coupling of the open-side coupling portion 26, and the coupling of the open-side coupling portion 26 is set in the same way as FIG. 14A and FIG. 15A.

If the element portion 602 in the feed-side coupling portion 24 is moved away from the feed element 4, the coupling is correspondingly weakened and the VSWR characteristics of the antenna apparatus 2 are changed. FIG. 16 depicts the VSWR characteristics of the antenna apparatus 2 before and after the change of the distance Δd=4 [mm]. In FIG. 16, a dashed line is the VSWR characteristics before the change and a solid line shows the VSWR characteristics after the change. As seen by comparing the characteristics, the VSWR of the frequency band F2 is slightly deteriorated and the characteristics of the frequency band F3 are moved to the higher side.

As shown in FIG. 14C and FIG. 15C, the distance Δd from the default position to the element portion 602 is set to 8 [mm], for example. FIG. 15C is an XVC-XVC sectional view of FIG. 14C. In this case, correspondingly to the movement of the element portion 602 by the distance Δd, the element portion 603 is elongated by that distance so as not to change the coupling of the open-side coupling portion 26, and the element lengths are extended at a bending portion 38 between the element portion 601 and the element portion 602 and a bending portion 40 between the element portion 601 and the element portion 603 to adjust the resonant frequencies.

If the distance Δd is increased to about Δd=8 [mm], the VSWR characteristics of the antenna apparatus 2 are further changed. FIG. 17 depicts the VSWR characteristics of the antenna apparatus 2 before and after the change of the distance Δd=8 [mm]. In FIG. 17, a dashed line is the VSWR characteristics before the change and a solid line shows the VSWR characteristics after the change. As seen by comparing the characteristics, although the sharpness is slightly deteriorated in the resonance of the frequency band F2, the characteristics of the frequency band F3 are moved to the higher side and the VSWR thereof is considerably deteriorated. X1 shows the deteriorated portion.

Although the antenna characteristics such as the desired VSWR characteristics can be controlled by the distance Ad since the coupling between the feed side of the feed element 4 and the non-feed element 6 is dependent on the distance Δd between the feed element 4 and the element portion 602 of the non-feed element 6 in the antenna apparatus 2, the feed side and the non-feed element 6 must strongly be coupled to improve the VSWR characteristics.

(2) Coupling Adjustment of Open-Side Coupling Portion 26 (Mainly, Adjustment of Distance Δd)

In the antenna apparatus 2, FIG. 18A shows the default shape and the default position of the non-feed element 6 as shown in FIG. 14A. In the non-feed element 6, W22*a* is the length (default length) of the element portion 602, and W23*a* is the length (default length) of the element portion 603.

On the other hand, as shown in FIG. 18*i*, the length of the element portion 603 is changed to move the position of the open end 16 of the element portion 603 away from the default position (FIG. 18A) by the distance Δd, and this distance Δd is set to 4 [mm], for example. In this case, correspondingly to the movement of the element portion 603 by the distance Δd, the element portion 602 is elongated by the distance Δd so as not to change the coupling of the feed-side coupling portion 24, and the element lengths are extended at the bending portion 38 between the element portion 601 and the element portion 602 and the bending portion 40 between the element portion 601 and the element portion 603 to adjust the resonant frequencies. In this case, when W22*b* is the length of the element portion 602 and W23*b* is the length of the element portion 603, the magnitude correlation relative to the default lengths W22*a* and W23*a* is W22*b*>W22*a* and W23*b*=W23*a*.

If the element portion 603 in the open-side coupling portion 26 is moved away from the feed element 4, the coupling is correspondingly weakened and the VSWR characteristics of the antenna apparatus 2 are changed. FIG. 19 depicts the VSWR characteristics of the antenna apparatus 2 before and after the change of the distance Δd=4 [mm]. In FIG. 19, a dashed line is the VSWR characteristics before the change and a solid line shows the VSWR characteristics after the change. As seen by comparing the characteristics, changes are only slightly recognized in the higher side of the frequency band F1 and the frequency band F3.

As shown in FIG. 18C, the position of the open end 16 of the element portion 603 is moved away from the default position (FIG. 18A) by the distance Δd, and this distance Δd is set to Δd=8 [mm] t for example. In this case, correspondingly to the movement of the element portion 603 by the distance Δd, the element portion 602 is elongated by that distance so as not to change the coupling of the feed-side coupling portion 24, and the element lengths are extended at the bending portion 38 between the element portion 601 and the element portion 602 and the bending portion 40 between the element portion 601 and the element portion 603 to adjust the resonant frequencies.

If the distance Δd is increased to about Δd=8 [mm], the VSWR characteristics of the antenna apparatus 2 are further changed. FIG. 20 depicts the VSWR characteristics of the antenna apparatus 2 before and after the change of the distance Δd=8 [mm]. In FIG. 20, a dashed line is the VSWR characteristics before the change and a solid line shows the VSWR characteristics after the change. As seen by comparing the characteristics, the higher side of the characteristics of the frequency band F1 is changed, and the characteristics of the frequency band F3 are somewhat deteriorated. X2 shows the deteriorated portion. In this case, when W22*c* is the length of the element portion 602 and W23*c* is the length of the element portion 603, the magnitude correlation relative to the default lengths W22*a*, W23*a*, and the length W22*b*, W23*b* in the case of FIG. 18B is W22*c*>W22*b*>W22*a* and W23*c*=W23*b*=W23*a*.

Since the VSWR characteristics of the antenna apparatus 2 are changed due to the coupling strength of the open-side coupling portion 26, the coupling of the open-side coupling portion 26 is necessary and it is beneficial to enhance the coupling strength thereof.

(3) Another Coupling Adjustment of Feed-Side Coupling Portion 24 (Adjustment of Shape and Distance Δd of Non-Feed Element 6)

In the antenna apparatus 2, FIG. 21A shows the default shape and the default position of the non-feed element 6 as shown in FIG. 14A.

On the other hand, as shown in FIG. 21B, the element portion 602 is folded back to establish a folding back portion 42 in the element portion 602; the edge of the folding back portion 42 is moved from the default position by distance Δd; and this distance Δd is set to Δd=4 [mm], for example. In this case, the length of the element portion 602 including the folding back portion 42 is set longer than that of the element portion 602 shown in FIG. 21A (the default length), and the coupling of the teed-side coupling portion 24 is established as is the case with FIG. 21A (FIG. 14A) without changing the length of the element portion 603 so as not to change the coupling of the open-side coupling portion 26.

If the folding back portion 42 is set in the element portion 602 in the feed-side coupling portion 24 and is moved away from the feed element 4, the VSWR characteristics of the antenna apparatus 2 are changed. FIG. 22 depicts the VSWR characteristics of the antenna apparatus 2 before and after the change of the distance Δd=4 [mm]. In FIG. 22, a dashed line is the VSWR characteristics before the change and a solid line shows the VSWR characteristics after the change. As seen by comparing the characteristics, the characteristics of the frequency band F1 are not changed, and changes are only slightly recognized in the frequency hand F3. Although the coupling is correspondingly weakened by moving the element portion 603 away from the feed element 4, since the facing areas of the folding back portion 42 and the feed element 4 are expanded, it is understood that the electromagnetic coupling is complemented and that the considerable deterioration of VSWR is avoided.

As shown in FIG. 21C, the folding back portion 42 of the element portion 602 is extended and the distance Δd from the default position is set to Δd=8 [mm], for example. In this case, the length of the element portion 603 is set equal to FIG. 21A so as not to change the coupling of the open-side coupling portion 26.

If the distance Δd is increased to about Δd=8 [mm], the VSWR characteristics of the antenna apparatus 2 are further changed. FIG. 23 depicts the VSWR characteristics of the antenna apparatus 2 before and after the change of the distance Δd=8 [mm]. In FIG. 23, a dashed line is the VSWR characteristics before the change and a solid line shows the VSWR characteristics after the change. As seen by comparing the characteristics, although the characteristics of the frequency band F1 are not changed, the VSWR is deteriorated in the frequency bands F2 and F3. X3 shows the deteriorated portion. Although the coupling is correspondingly weakened since the element portion 602 is moved away from the feed element 4 by the longer distance, since the folding back portion 42 is elongated and the area facing to the teed element 4 is expanded, it is understood that the coupling is correspondingly enhanced and that the considerable deterioration of VSWR is avoided.

Although the adjustment to the desired VSWR characteristics can be achieved since the coupling between the feed side of the feed element 4 and the non-feed element 6 is dependent on the distance Δd between the feed element 4 and the element portion 602 of the non-feed element 6 in the antenna apparatus 2, the feed side and the non-feed element 6 must strongly be coupled to improve the VSWR characteristics, and when improving the VSWR, it is beneficial for the enhancement of the coupling to extend the folding portion 42 of the feed side.

(4) Another Coupling Adjustment of Open-Side Coupling Portion 26 (Adjustment of Shape and Distance Δd of Non-Feed Element 6)

In the antenna apparatus 2, FIG. 24A shows the default shape and the default position of the non-feed element 6 as shown in FIG. 14A.

On the other hand, as shown in FIG. 24B, the element portion 603 is folded back to establish a folding back portion 44 in the element portion 603 and is elongated; the edge of the folding back portion 44 is moved away from the default position (FIG. 24A) by distance Δd; and this distance Δd is set to Δd=4 [mm], for example. In this way, the coupling of the feed-side coupling portion 24 is established as is the case with FIG. 24A (FIG. 14A) without changing the length of the element portion 602 so as not to change the coupling of the feed-side coupling portion 24.

If the folding back portion 44 of the element portion 603 in the open-side coupling portion 26 is moved away from the feed element 4, the coupling is correspondingly weakened and the VSWR characteristics of the antenna apparatus 2 are changed. FIG. 25 depicts the VSWR characteristics of the antenna apparatus 2 before and after the change of the distance Δd=4 [mm]. In FIG. 25, a dashed line is the VSWR characteristics before the change and a solid line shows the VSWR characteristics after the change. As seen by comparing the characteristics, changes are only slightly recognized in the higher side of the frequency band F1 and the frequency band F3. Although the coupling is correspondingly weakened by moving the element portion 603 away from the feed element 4, since the facing areas of the folding back portion 44 and the feed element 4 are expanded, it is understood that the electromagnetic coupling is complemented and that the considerable deterioration of VSWR is avoided.

As shown in FIG. 24C, the folding back portion 44 of the element portion 603 is further extended and the distance Δd from the default position is set to Δd=8 [mm], for example. In this case, the length of the element portion 602 is set to the same length so as not to change the coupling of the feed-side coupling portion 24.

If the distance Δd is increased to about Δd=8 [mm], the VSWR characteristics of the antenna apparatus 2 are further changed. FIG. 26 depicts the VSWR characteristics of the antenna apparatus 2 before and after the change of the distance Δd=8 [mm]. In FIG. 26, a dashed line is the VSWR characteristics before the change and a solid line shows the VSWR characteristics after the change. As seen by comparing the characteristics, the higher side of the characteristics of the frequency band F1 is changed and the characteristics of the frequency band F3 are somewhat deteriorated. X4 shows the deteriorated portion. Although the coupling is correspondingly weakened if the element portion 603 is moved away from the feed element 4 by the longer distance, since the folding back portion 44 is elongated, the area facing to the feed element 4 is expanded, and it is under stood that the coupling is correspondingly enhanced and that the considerable deterioration of VSWR is avoided.

Since the VSWR characteristics of the antenna apparatus 2 are also changed by the coupling strength of the open-side coupling portion 26, sufficient coupling in the open-side coupling portion 26 is necessary, and enhancement of the coupling strength leads to improvement of the VSWR. It is beneficial for achieving the electromagnetic coupling to extend the folding back potion 44.

Second Embodiment

Figure 27:
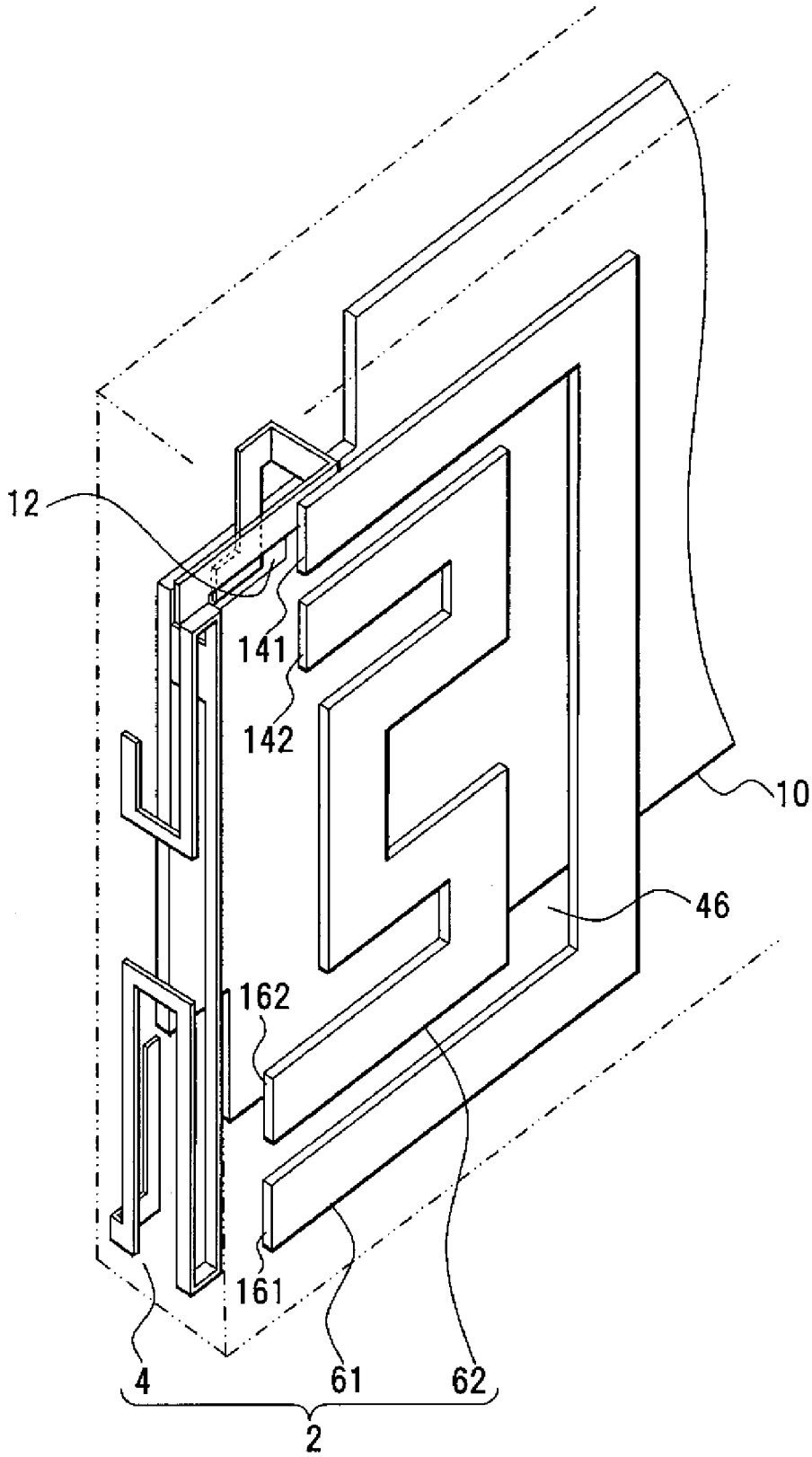
FIG. 27 is a perspective view of an antenna apparatus according to a second embodiment.
Figure 28:
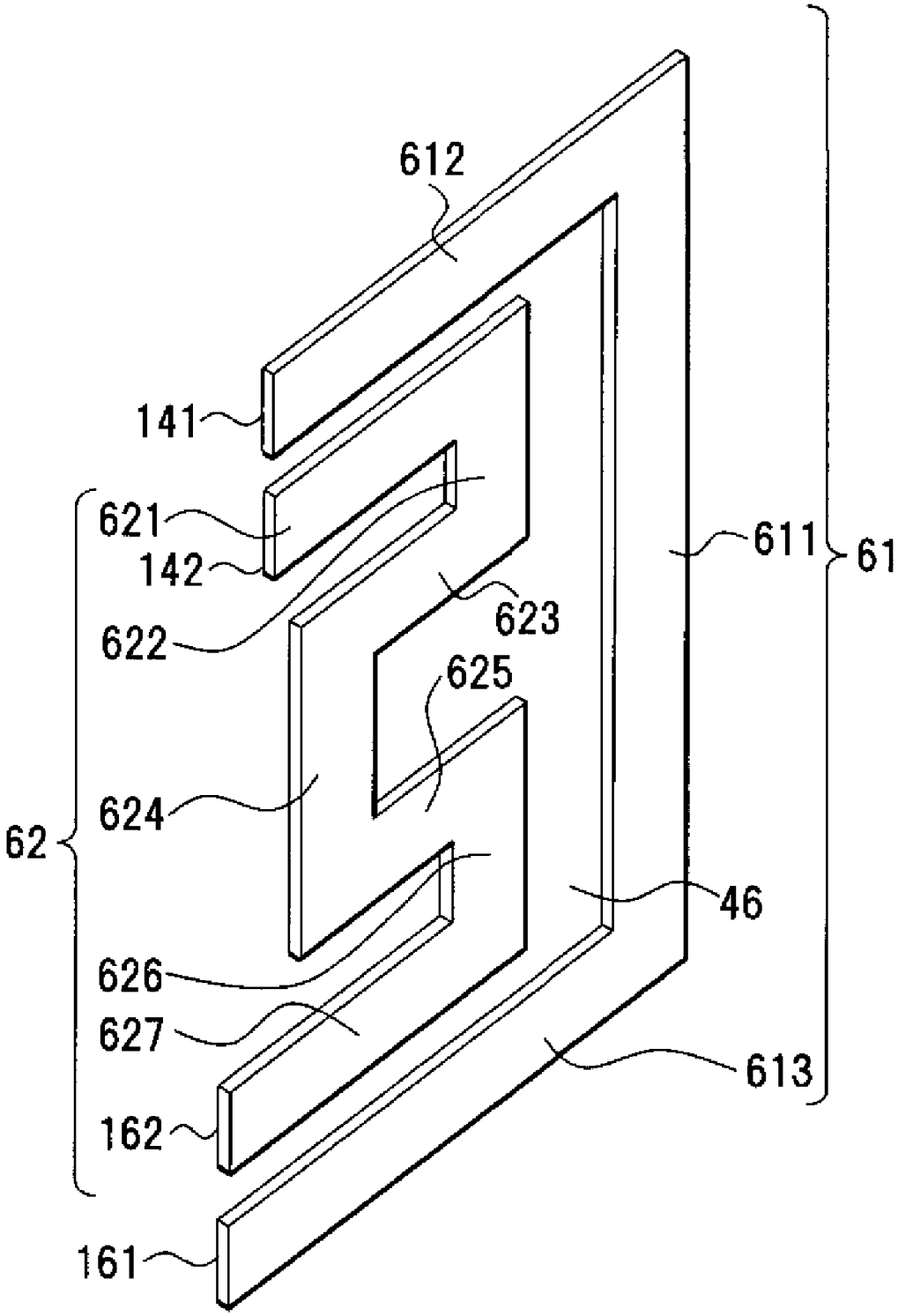
FIG. 28 is a perspective view of the non-feed element.
Figure 29:
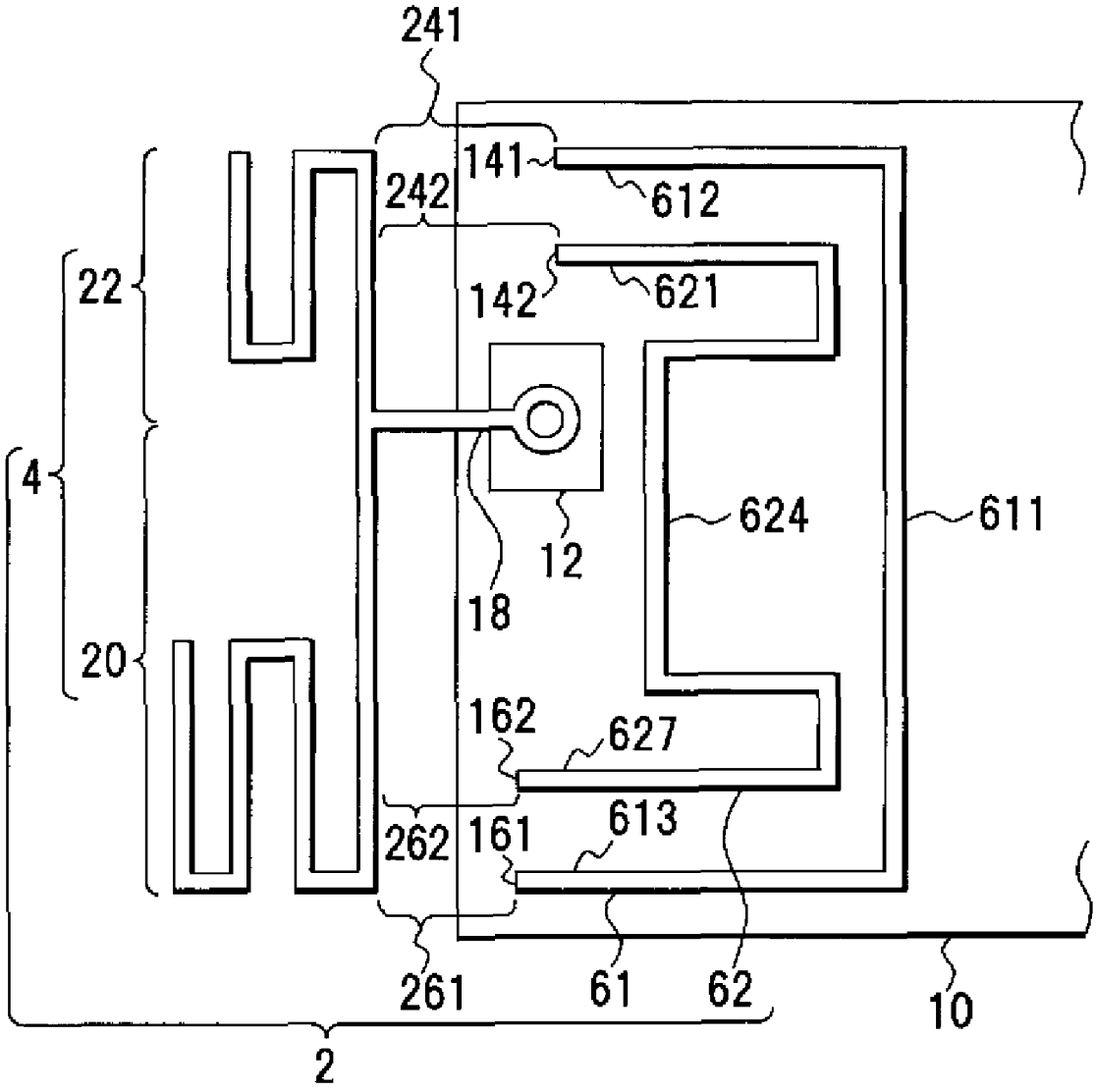
FIG. 29 depicts arrangement of a feed element, non-feed element, and printed circuit substrate.
Figure 30:
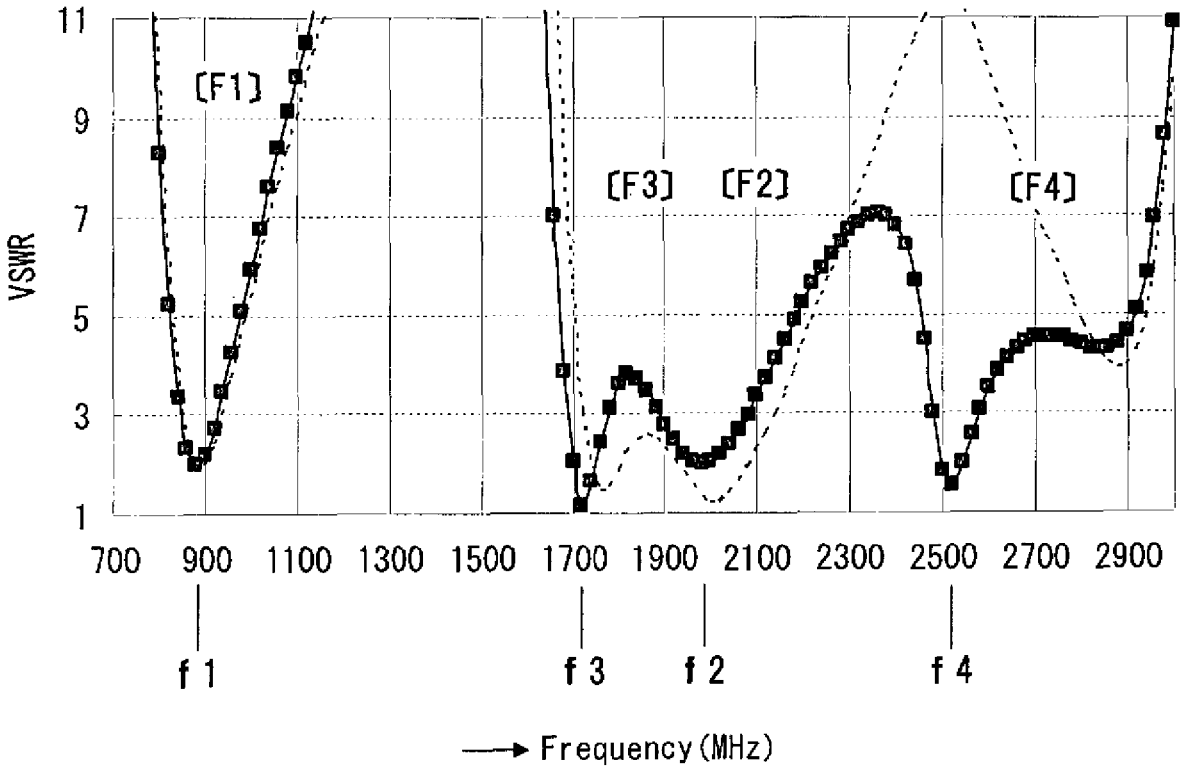
FIG. 30 depicts VSWR characteristics.

A second embodiment of the present invention will be described with reference to FIGS. 27, 28, 29, and 30. FIG. 27 is a perspective view of an antenna apparatus according to the second embodiment; FIG. 28 is a perspective view of the non-feed element; FIG. 29 depicts arrangement of a feed element, non-feed element, and printed circuit substrate; and FIG. 30 depicts VSWR characteristics. In FIGS. 27 and 29, the same reference numerals are added to the same portions as FIGS. 1 to 3.

Although the antenna apparatus 2 including the single non-feed element 6 has been described in the first embodiment, a plurality of the non-feed elements 6 may be included to realize resonant frequencies in different frequency bands with the non-feed elements 6.

In the antenna apparatus 2 according to the second embodiment, as shown in FIG. 27, first and second non-feed elements 61, 62 are disposed for the single feed element 4, and resonant frequencies are realized in a plurality of bands by the electromagnetic coupling between the non-feed elements 61, 62 and the feed element 4.

The non-feed element 61 has the same shape as the non-feed element 6 of the first embodiment and has a C-shape formed by element portions 611, 612, and 613 as shown in FIGS. 28 and 29. A feed-side coupling portion 241 is established for coupling an open end 141 of the element portion 611 to the feed side of the feed element 4 and an open-side coupling portion 261 is established for coupling an open end 161 of the element portion 613 to the open side of the feed element 4 to achieve the electromagnetic coupling between the non-feed element 61 and the feed element 4.

A non-teed element 62 is disposed inside the non-feed element 61 and is disposed on the same plane as the non-feed element 61. That is, the non-feed element 62 is also located within the surface of the printed circuit substrate 10 with the distance D from the upper surface of the printed circuit substrate 10.

This non-feed element 62 forms more bending portions than the non-feed element 61 to ensure a long element length within a space 46 inside the non-feed element 61. A plurality of element units 621, 622, 623, 624, 625, 626, and 627 are formed and sectionalized by the bending portions. The element portions 621, 623, 625, and 627 are located parallel to the element portions 612 and 613, and the element portions 622, 624, and 626 are located parallel to the element portion 611. That is, the non-feed element 6 forms a shape of a numeric character "3".

A feed-side coupling portion 242 is established for coupling an open end 142 of the element portion 621 to the feed side of the feed element 4 and an open-side coupling portion 262 is established for coupling an open end 162 of the element portion 627 to the open side of the feed element 4 to achieve the electromagnetic coupling between the non-feed element 62 and the feed element 4.

When both the non-feed elements 61 and 62 are disposed for the single feed element 4 to achieve the electromagnetic coupling between the feed element 4 and the non-feed element 61 as well as between the feed element 4 and the non-feed element 62, the antenna characteristics can be acquired which have more resonant frequencies than the antenna apparatus of the first embodiment. FIG. 30 depicts the VSWR characteristics thereof. In FIG. 30, a dashed line is the VSWR characteristics of the antenna apparatus of the first embodiment and a solid line shows the VSWR characteristics of the antenna apparatus of the second embodiment. As revealed by comparing the characteristics, in this antenna apparatus 2, the resonant frequencies are acquired in each of the frequency bands F1, F2, F3, and F4, and f4 is acquired by disposing the non-feed element 62.

When increasing the number of the disposed non-feed elements 6 to achieve the coupling with the feed element 4, the number of resonances can be acquired correspondingly to the number of the disposed non-feed elements 6 in addition to the multiple resonance of the feed element 4, and communication can be supported in a large number of communication bands in conjunction with the downsizing of the antenna apparatus 2.

Third Embodiment

Figure 31:
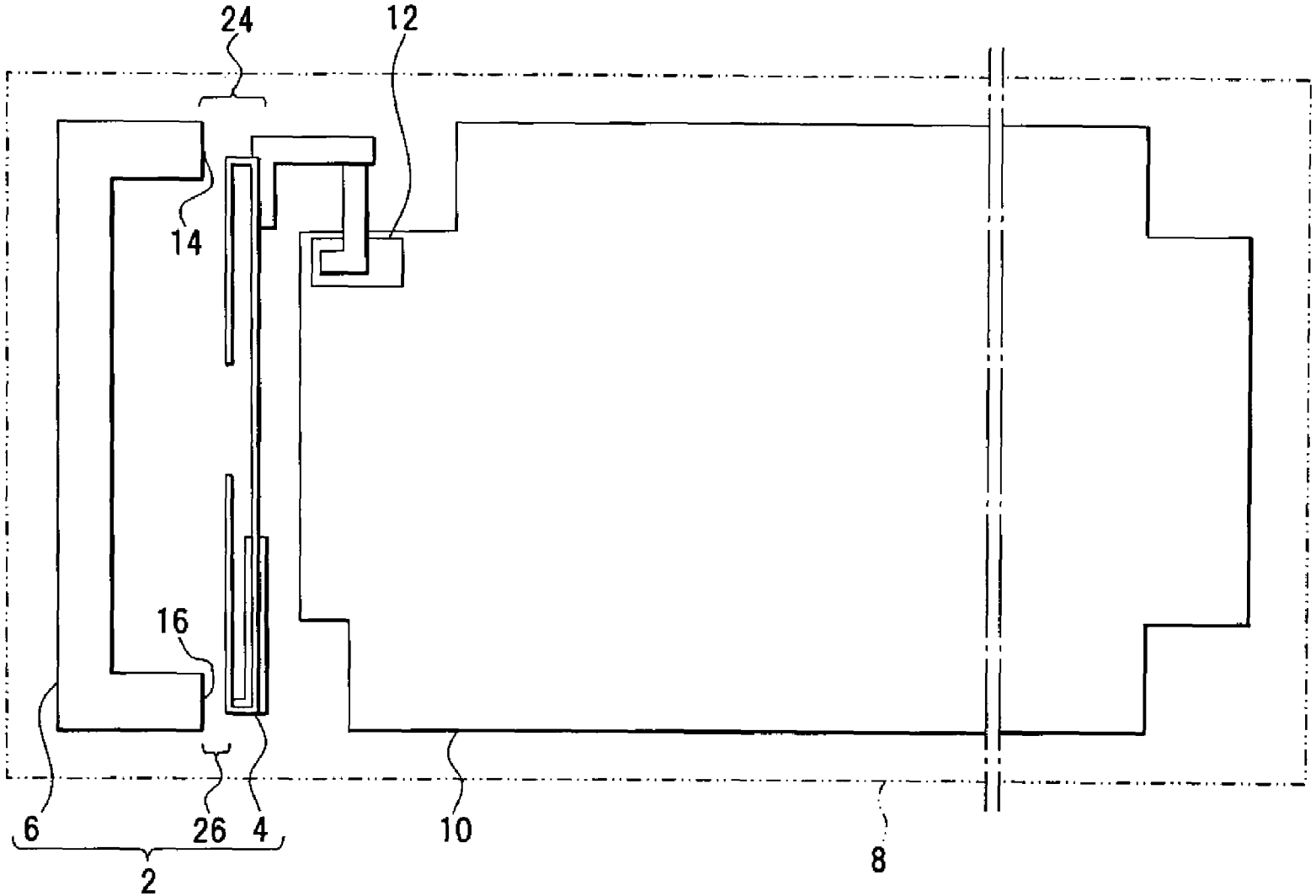
FIG. 31 depicts an antenna apparatus according to a third embodiment.
Figure 32:
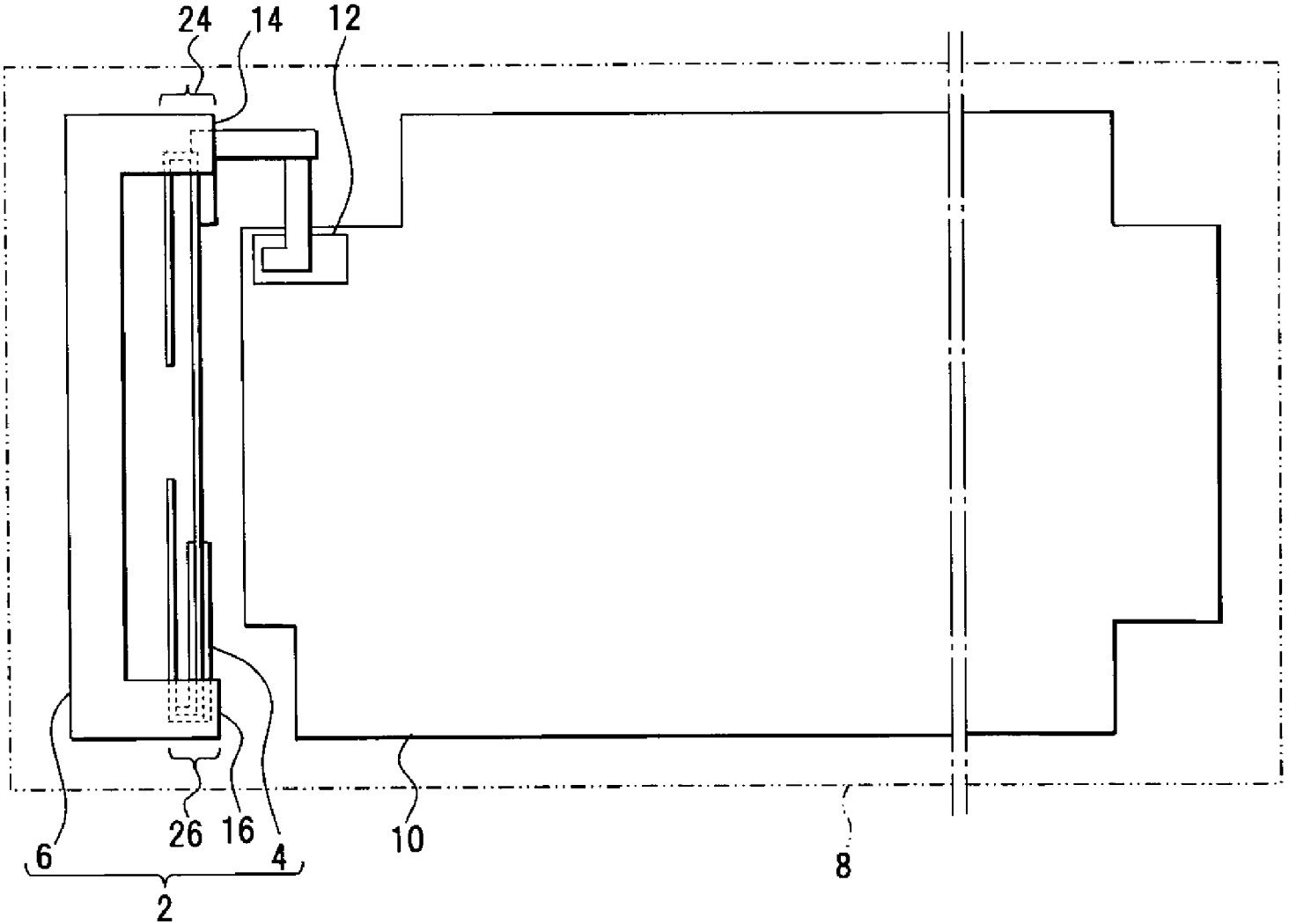
FIG. 32 depicts a variation of the antenna apparatus.

A third embodiment of the present invention will be described with reference to FIGS. 31 and 32. FIG. 31 depicts an antenna apparatus according to the third embodiment and FIG. 32 depicts a variation thereof. In FIGS. 31 and 32, the same reference numerals are added to the same portions as FIG. 1.

Although the non-feed element 6 (FIG. 1) or the non-feed elements 61 and 62 (FIG. 27) are disposed over the upper surface of the print circuit substrate 10 within the surface of the print circuit substrate 10 in the first and second embodiments, the non-feed element 6 or the non-feed elements 61 and 62 may be disposed outside the surface of the print circuit substrate 10. Such structure can enhance the radiation efficiency of the non-feed element.

Therefore, in the third embodiment, as shown in FIG. 31, the non-feed element 6 is disposed on the side of the feed element 4, and the feed-side coupling portion 24 and the open-side coupling portion 26 are established outside the surface of the printed circuit substrate 10 to realize the electromagnetic coupling of the feed element 4 and the non-feed element 6 outside the surface of the printed circuit substrate 10. With such structure, the multi-frequency resonance can also be acquired and the radiation efficiency of the non-feed element can be enhanced.

As shown in FIG. 32, the feed-side coupling portion 24 and the open-side coupling portion 26 may be configured by overlapping the feed element 4 with the non-feed element 6 disposed on the side of the feed element 4 outside the surface of the printed circuit substrate 10 without contacting the feed element 4. With such structure, the multi-frequency resonance can also be acquired; the coupling strengths are enhanced in the feed-side coupling portion 24 and the open-side coupling portion 26; and the VSWR characteristics of the antenna apparatus 2 are improved.

Fourth Embodiment

Figure 33:
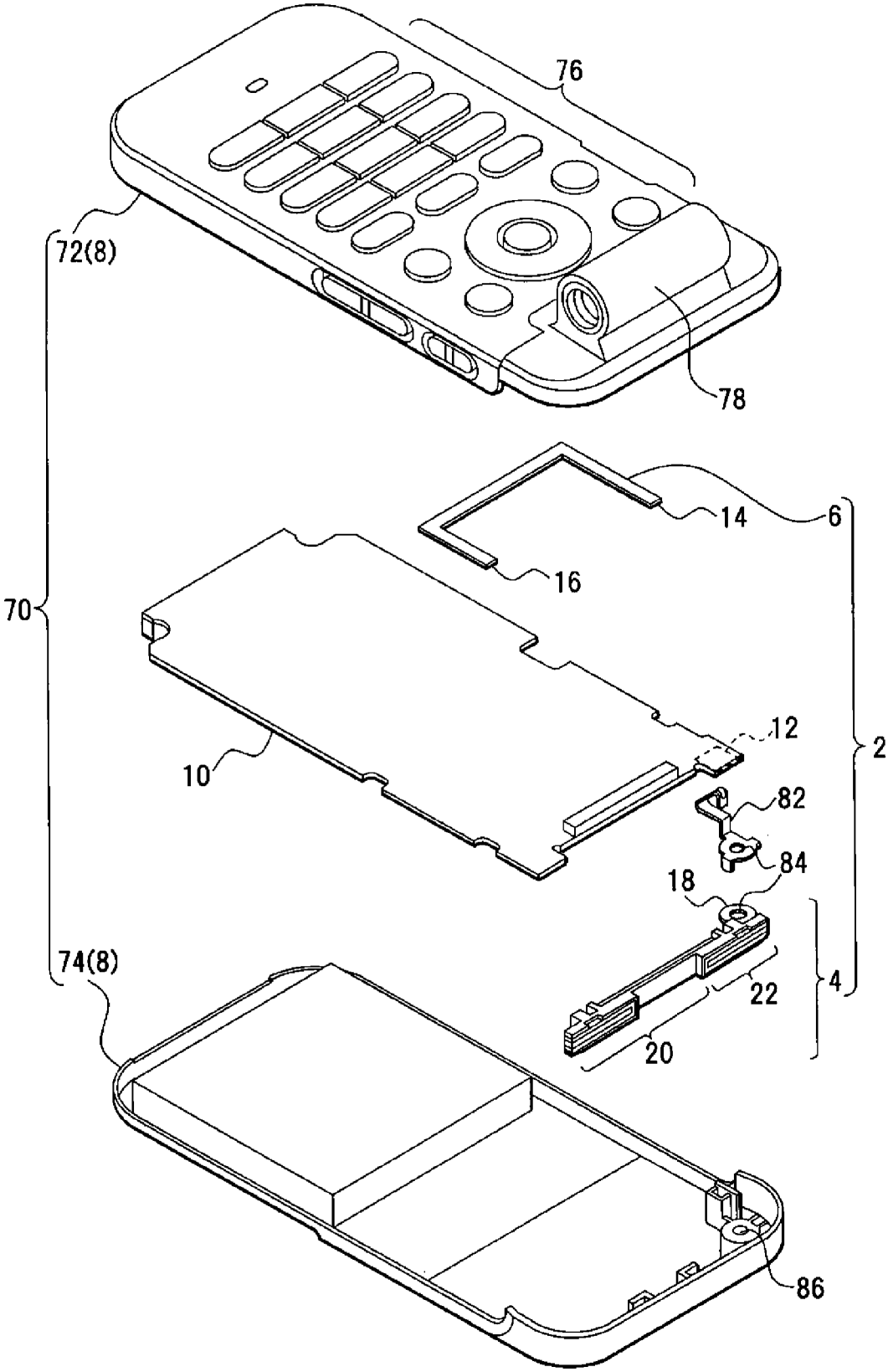
FIG. 33 is an exploded perspective view of a portable phone according to a fourth embodiment.
Figure 34:
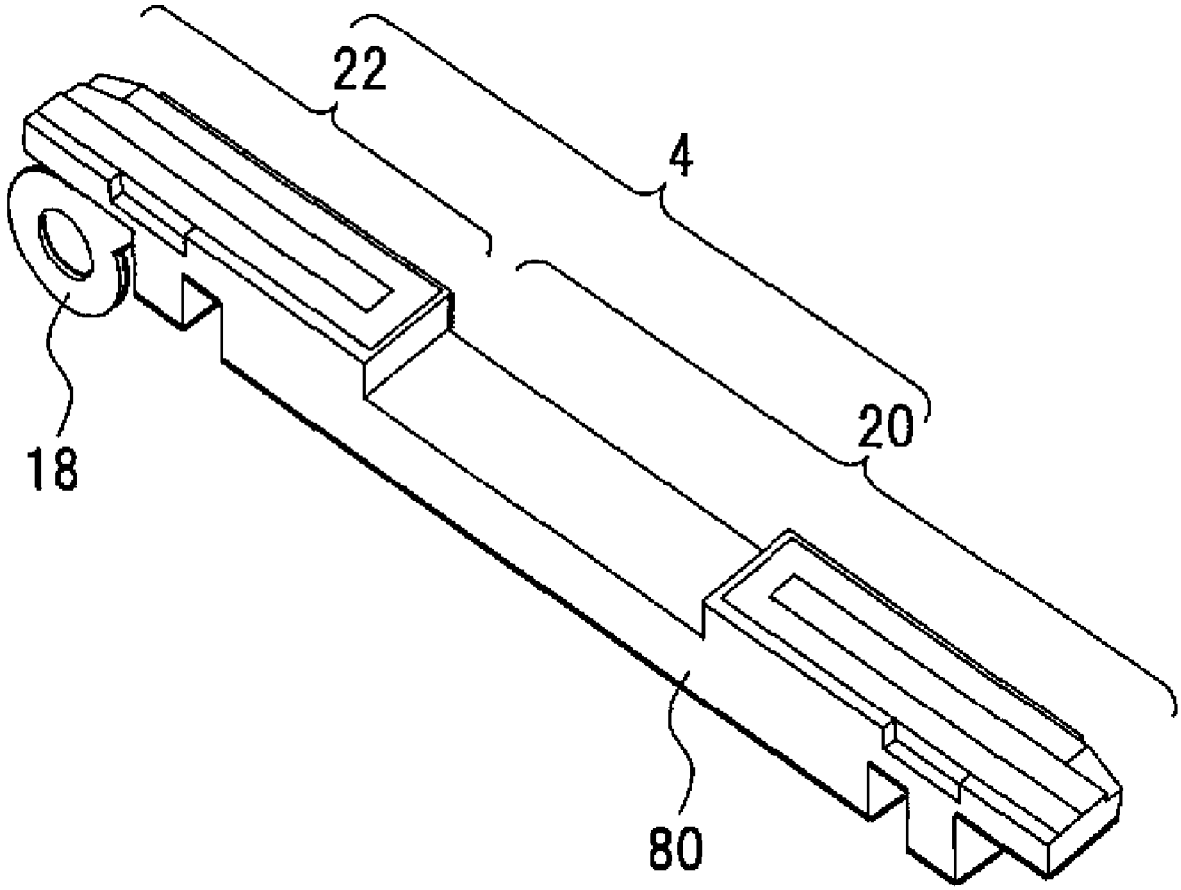
FIG. 34 is a perspective view of a feed element.
Figure 35:
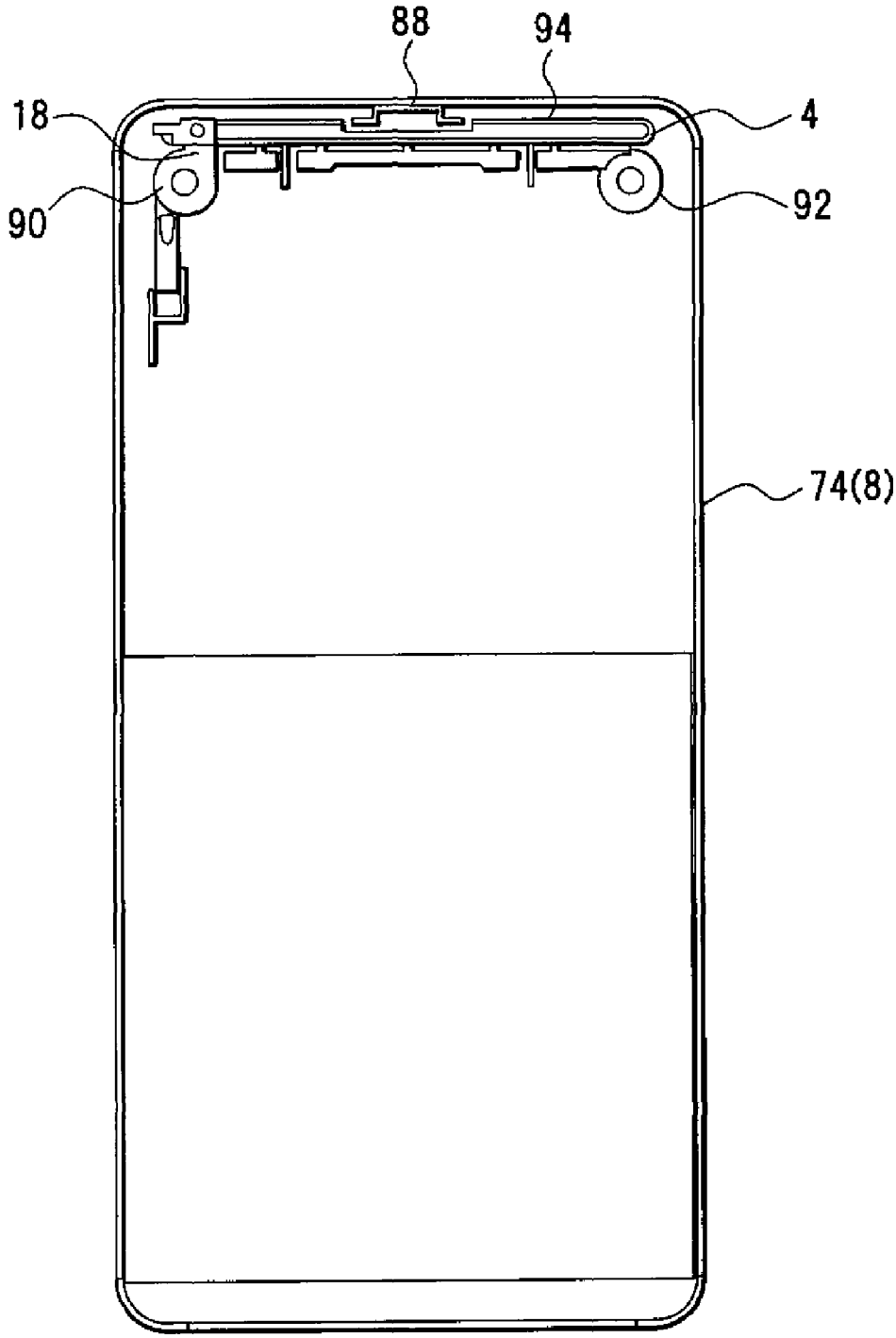
FIG. 35 depicts a fixed rear case unit of another portable phone.
Figure 36:
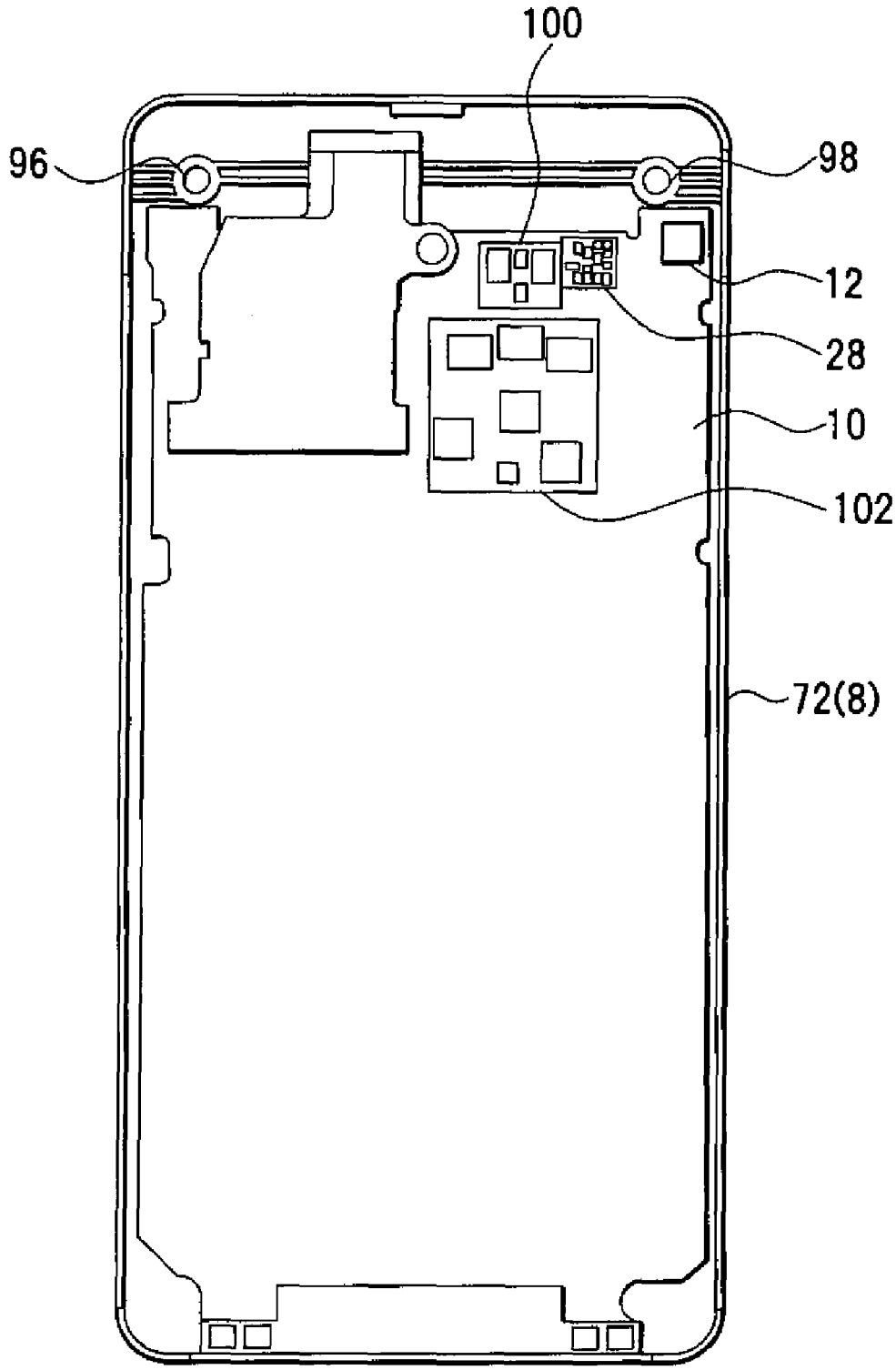
FIG. 36 depicts a fixed front case unit corresponding to the fixed rear case unit of FIG. 35.

A fourth embodiment of the present invention will be described with reference to FIG. 33, FIG. 34, FIG. 35, and FIG. 36. FIG. 33 is an exploded perspective view of a portable phone; FIG. 34 is a perspective view of a feed element; FIG. 35 depicts a fixed rear case unit of another portable phone; and FIG. 36 depicts a fixed front case unit corresponding to the fixed rear case unit of FIG. 35. In FIGS. 33, 34, 35, and 36, the same reference numerals are added to the same portions as FIG. 1.

This portable phone 70 is an example of a wireless communication apparatus using the antenna apparatus 2 and includes a fixed front case unit 72 and a fixed rear case unit 74. The fixed front case unit 72 and the fixed rear case unit 74 are made of an insulating material such as a synthetic resin and configure the above housing 8. The fixed front case unit 72 has an input operating unit 76, a hinge unit 78, etc., formed thereon; a movable case unit not shown is foldably attached to the hinge unit 78; and a displaying unit, etc., are attached to the movable case unit.

Within the housing 8 consisting of the fixed front case unit 72 and the fixed rear case unit 74, the antenna apparatus 2 including the feed element 4 and the non-feed element 6 is disposed along with the printed circuit substrate 10.

As shown in FIG. 34, the feed element 4 includes an element housing unit 80 made of a dielectric material such as a synthetic resin, and the element housing unit 80 has the feed connecting unit 18 formed thereon and has the antenna element units 20, 22 attached thereto. If the antenna element units 20, 22 are disposed on the element housing unit 80 made of a dielectric material, the shape of the feed element 4 can be regulated to a certain shape corresponding to the element housing unit 80; the antenna element units 20, 22 can integrally be formed by resin molding, etc., along with the element housing unit 80; and the element length can be shortened due to the dielectric material to which the antenna element units 20, 22 are attached.

The feed element 4 is built into the fixed rear case unit 74, and a connecting conductor 82 consisting of a spring member is disposed between the feed connecting unit 18 and the feeding portion 12 of the printed circuit substrate 10. A fixing hole 84 is formed in the feed connecting unit 18 and the connecting conductor 82, and the feed element 4 is firmly fixed by a fixing means not shown such as a screw to a connection fixing portion 86 formed on the fixed rear case unit 74. That is, the fixation of the feed element 4 to the fixed rear case unit 74 is maintained concurrently with the electric connection between the feed connecting unit 18 and the connecting conductor 82.

The connecting conductor 82 fixed to the feed connecting unit 18 of the feed element 4 is contacted with the feeding portion 12 of the printed circuit substrate 10, and the feeding portion 12 and the feed connecting unit 18 are electrically connected via the connecting conductor 82 due to the elasticity of the connecting conductor 82.

The non-feed element 6 is disposed over the upper surface of the printed circuit substrate 10 as described above and the open end 14 of the non-feed element 6 is in the vicinity of the feeding portion 12 to configure the feed-side coupling portion 24 (FIG. 3). The open end 16 is in the vicinity of the feed element 4 to configure the open-side coupling portion 26 (FIG. 3).

With such structure, the single teed antenna apparatus 2 can acquire the multifrequency resonance and can communicate in a plurality of bands. The antenna apparatus 2 can compactly be housed within the housing 8 and occupies a small proportion of the housing 8, and the radio communicating apparatus such as the portable phone 70 can be miniaturized. Especially, with regard to the feed element 4 configured by using the element housing unit 80, the shape can be uniformed and the characteristics can be stabilized, and since the dielectric material is used, the antenna length of the feed element 4 is reduced, which contributes to the miniaturization of the antenna apparatus 2. If the antenna apparatus 2 is used in various radio communicating apparatuses as is the case with the portable phone 70 using this antenna apparatus 2, the occupancy proportion of the antenna apparatus can be reduced in the radio communicating apparatuses to achieve the miniaturization thereof.

Although the element housing unit 80 is used for configuring the feed element 4 in this embodiment, fixing portions 90, 92 are formed in the vicinity of a case edge 88 of the fixed rear case unit 74; the feed element 4 is disposed in a space 94 formed between the fixing portions 90, 92 and the case edge 88; and the feed connecting unit 18 of the feed element 4 is located at the fixing unit 90, as shown in FIG. 35 in another configuration example. The feed element 4 is a belt-shaped conductive material that is bent and located, and a dielectric material not shown is disposed therein. This structure may also be available.

For this structure of the fixed rear case unit 74, as shown in FIG. 36, on the fixed front case unit 72, the printed circuit substrate 10 is disposed and fixing portions 96 and 98 are formed correspondingly to the fixing portions 90 and 92. The feeding portion 12 is disposed and the matching circuit 28 is mounted on the printed circuit substrate 10 and, in this embodiment, an antenna switch 100, a radio circuit 102, etc., are mounted adjacently to this matching circuit 28. A connecting conductor not shown is disposed between the feeding portion 12 and the feed connecting unit 18 of the feed element 4 as described above to connect the feed connecting unit 18 of the feed element 4 to the feeding portion 12. This structure may also be available.

Fifth Embodiment

Figure 37A:
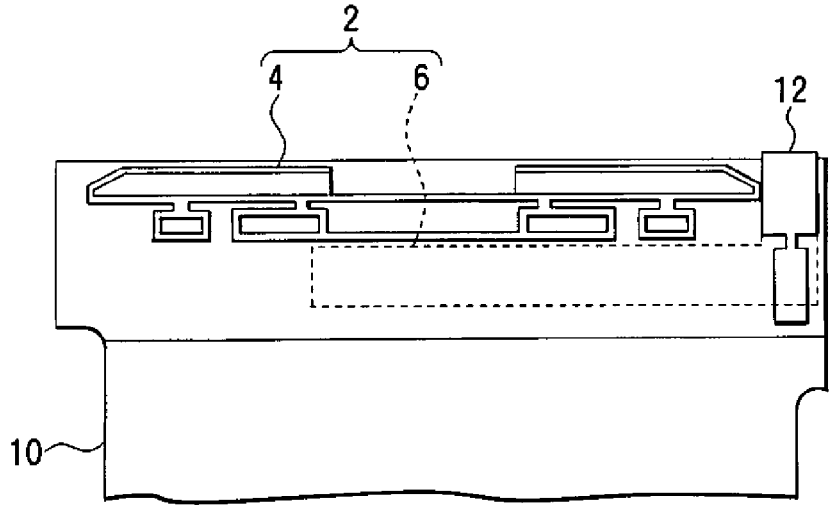
FIGS. 37A and 37B depict an antenna apparatus according to a fifth embodiment.
Figure 37B:
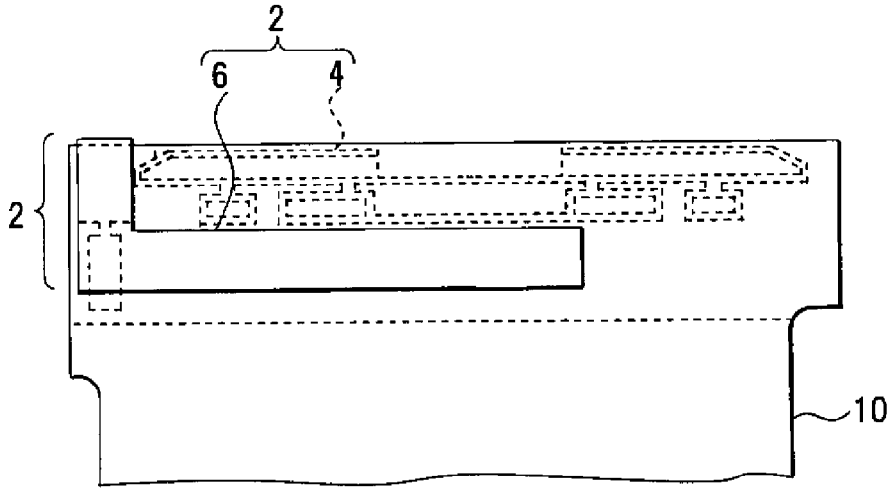
Figure 38:
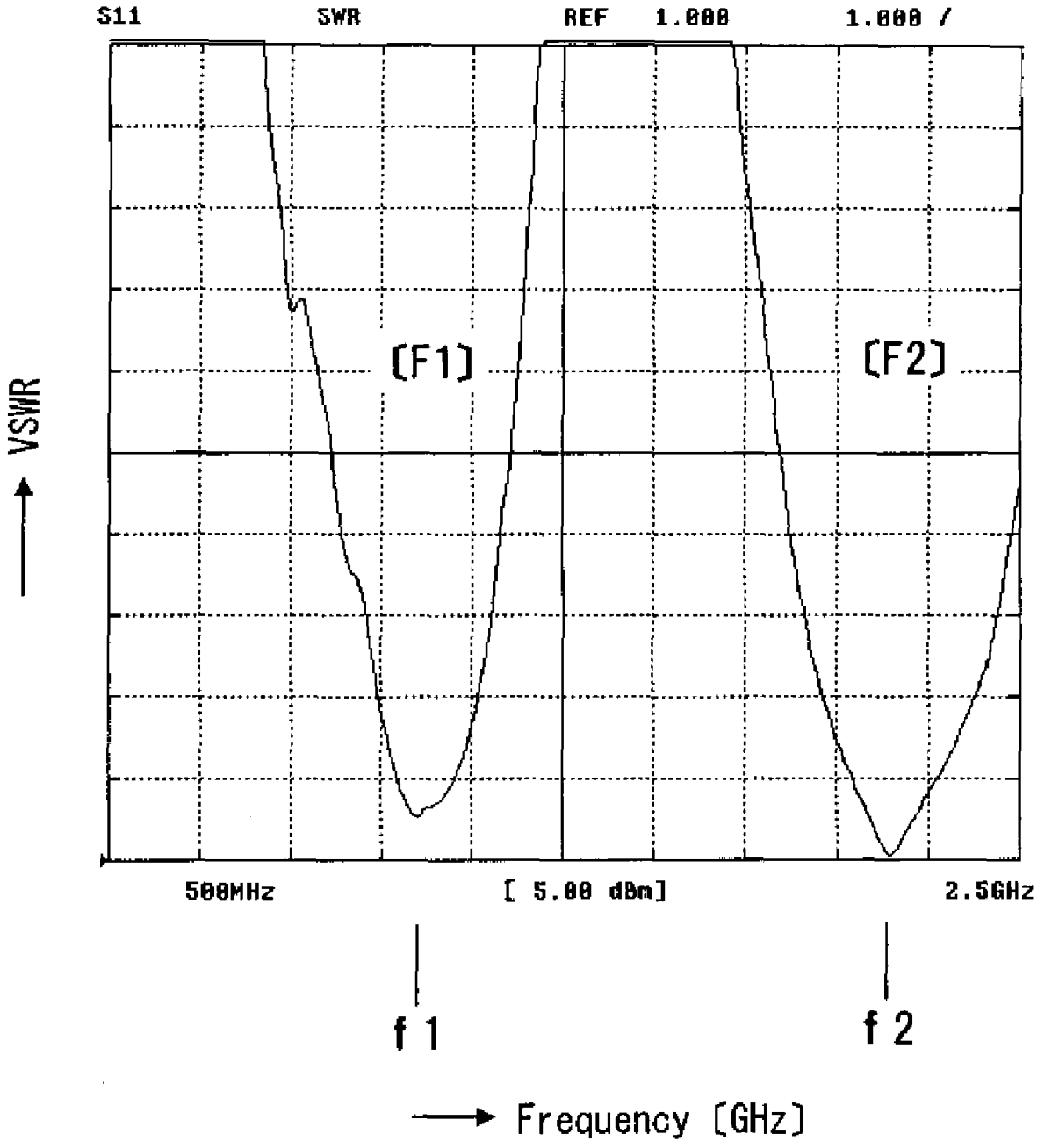
FIG. 38 depicts VSWR characteristics when the non-feed element is not disposed.
Figure 39:
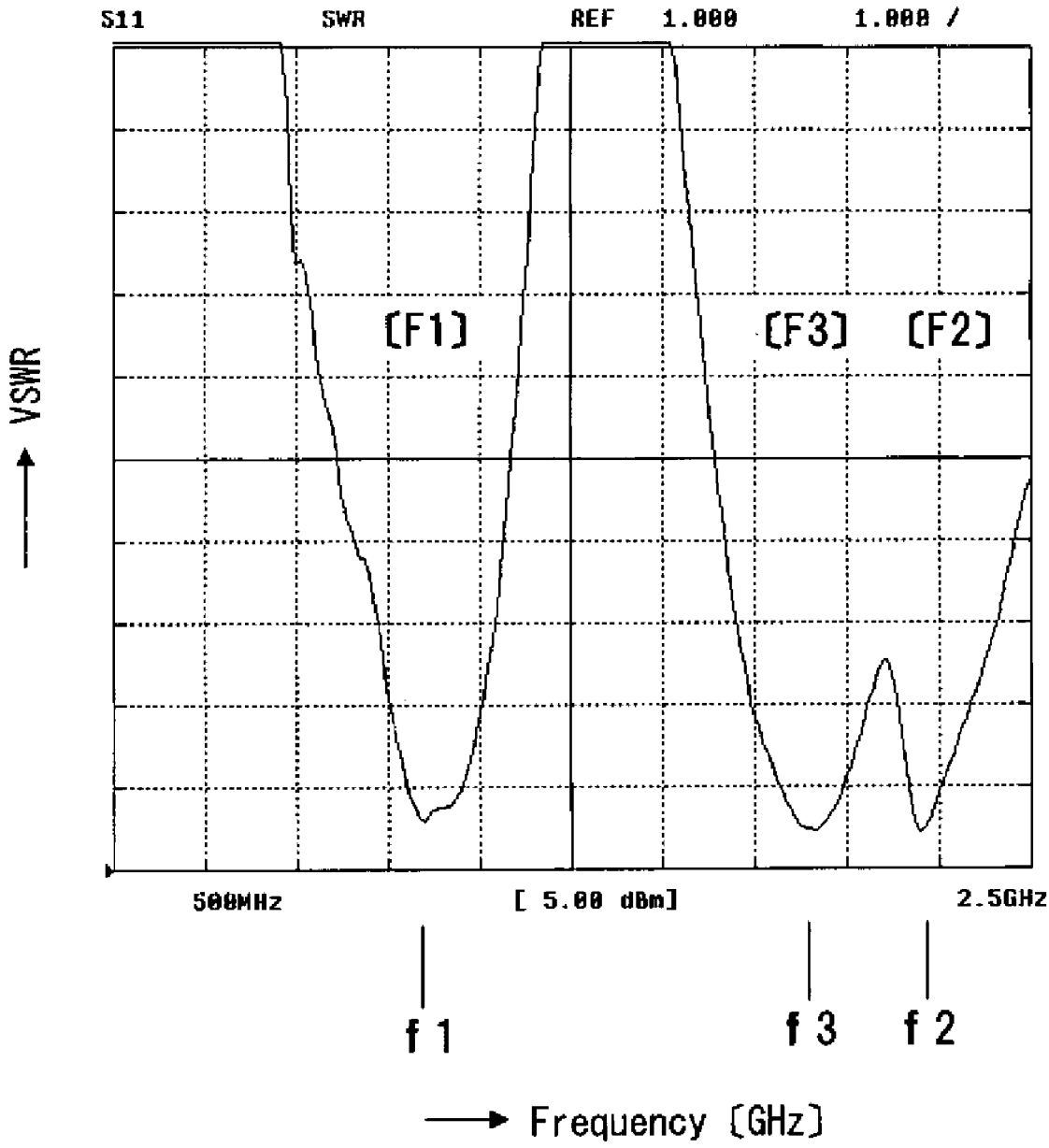
FIG. 39 depicts VSWR characteristics when the non-feed element is disposed.

A fifth embodiment of the present invention will be described with reference to FIGS. 37A, 37B, 38, and 39. FIGS. 37A and 37B depict an antenna apparatus according to the fifth embodiment; FIG. 38 depicts VSWR characteristics when the non-feed element is not disposed; and FIG. 39 depicts VSWR characteristics when the non-feed element is disposed. In FIG. 37, the same reference numerals are added to the same portions as FIG. 1.

In the antenna apparatus 2 of this embodiment, as shown in FIG. 37A, the feed element 4 is disposed at an edge of one surface of the printed circuit substrate 10 and is connected to the feeding portion 12. The non-feed element 6 is located within the other surface of the printed circuit substrate 10, and a portion thereof is overlapped with the feeding portion 12 through the printed circuit substrate 10 to configure the feed-side coupling portion 24.

In an experimental result of this antenna apparatus 2, VSWR characteristics shown in FIG. 38 are acquired when the non-feed element 6 is not disposed and VSWR characteristics shown in FIG. 39 are acquired when the non-feed element 6 is disposed. In FIGS. 38 and 39, the resonant frequencies f1 and f2 of the feed element 4 are acquired in the frequency bands F1 and F2, and if the non-feed element 6 is disposed, resonance can be acquired at the resonant frequency f3 in the frequency band F3 corresponding to the non-feed element 6 as shown in FIG. 39.

When the feed element 4 is supplied with electricity, the feed element 4 and the non-feed element 6 are electromagnetically coupled and function as one antenna, and the resonant frequency of the non-feed element 6 is added to a plurality of resonant frequencies of the feed element 4 to realize the resonant frequencies due to multiple resonance.

Figure 40:
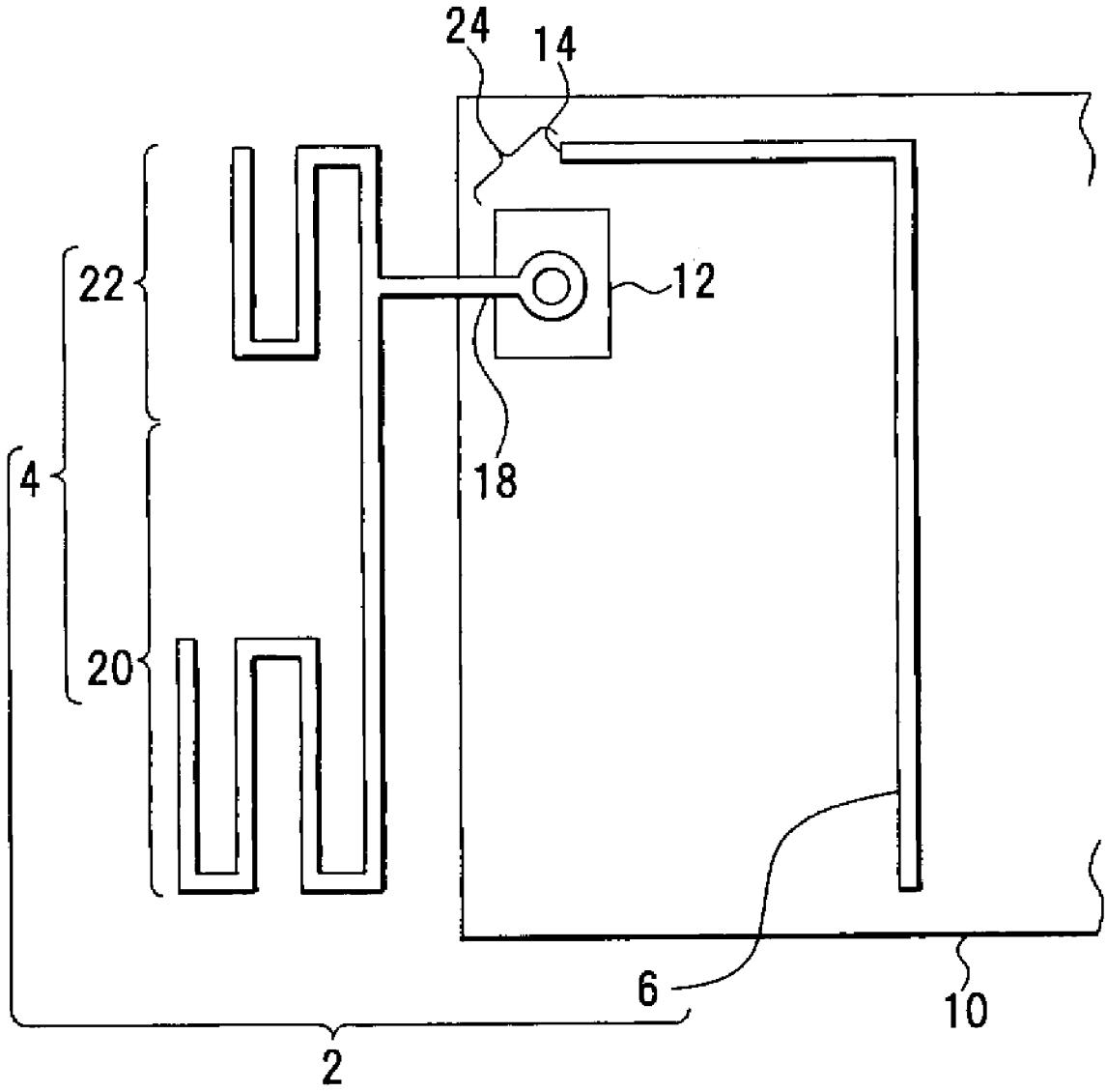
FIG. 40 depicts an antenna apparatus according to another embodiment.

Other Embodiments (1) Although the feed element 4 and the non-feed element 6 are electromagnetically coupled in both the feed-side coupling portion 24 and the open-side coupling portion 26 established between the feed element 4 and the non-feed element 6 in the above embodiments, the coupling may be achieved in only one of the feed-side coupling portion 24 and the open-side coupling portion 26. For example, the non-feed element 6 may be formed in an L-shape as shown in FIG. 40, and the open end 14 may be located close and coupled to the feed side of the feed element 4 to structure the antenna apparatus 2 causing the electromagnetic coupling only in the feed-side coupling portion 24. In FIG. 40, the same reference numerals are added to the same portions as FIG. 1.

(2) In the antenna apparatus 2 of the above embodiments, the coupling may be set stronger in the feed-side coupling portion 24 and weaker in the open-side coupling portion 26. Alternatively, the coupling may be set stronger in the open-side coupling portion 26 and weaker in the feed-side coupling portion 24.

Although the most preferable embodiments of the present invention have been described, the present invention is not limited to the above description and may be modified and altered by those skilled in the art based on the gist of the present invention described in claims or disclosed in the description of course, and it is needless to say that such modifications and alterations fall within the scope of the present invention.

The present invention relates to an antenna apparatus capable of multifrequency resonance and is useful since downsizing can be achieved; multifrequency resonance can be achieved; the antenna apparatus can be disposed in a small disposition space such as a flat disposition space; the radio communicating apparatus using the antenna apparatus can reduce occupancy proportion of the antenna apparatus to the radio communicating apparatus; and miniaturization thereof can be achieved.

What is claimed is:

1. An antenna apparatus capable of multifrequency resonance, comprising:

a feed element supplied with electricity;

a single or a plurality of non-feed element(s) disposed over a circuit substrate or outside the circuit substrate having a feeding portion disposed for supplying electricity to the feed element, the non-feed element(s) having an end by which the non-feed element(s) is located adjacent to the feed element; and a single or a plurality of coupling portion(s) that electromagnetically couples the feed element to the non-feed element(s) by the end, the feed element including first and second antenna element units which have different element length, the first and second antenna element units being formed from a connecting portion to the feeding portion that is on the circuit substrate, the antenna apparatus resonating in a frequency band of the feed element, the antenna apparatus resonating in a frequency band of the non-feed element.

2. The antenna apparatus of claim 1, wherein the coupling portion is one or both of a feed-side coupling portion that electromagnetically couples a feed side of the feed element to the non-feed element and an open-side coupling portion that electromagnetically couples an open side of the feed element to the non-feed element.

3. The antenna apparatus of claim 1, wherein the coupling portion has a coupling strength that is changed depending on a distance between the feed element and the non-feed element.

4. The antenna apparatus of claim 1, wherein the feed element includes a feed connecting unit connected to the feeding portion and a plurality of antenna element units branched from the feed connecting unit, the antenna element units each having a resonant frequency different for each antenna element unit.

5. The antenna apparatus of claim 1, wherein the feed element is located with an element portion bent within a width corresponding to a width of the circuit substrate to establish an antenna length necessary for resonance in a frequency band that should be set.

6. The antenna apparatus of claim 1, wherein the feed element connects a feed connecting unit to the feeding portion of the circuit substrate and locates an element portion outside the circuit substrate.

7. The antenna apparatus of claim 1, wherein the feed element includes an element portion located parallel to an edge of the circuit substrate.

8. The antenna apparatus of claim 1, wherein the non-feed element includes an element portion disposed in the vicinity of the feed element connected to the feeding portion of the circuit substrate.

9. The antenna apparatus of claim 1, wherein the non-feed element includes an element portion disposed in the vicinity of an open side of the feed element.

10. The antenna apparatus of claim 1, wherein the non-feed element includes an element portion located parallel to the feed element.

11. The antenna apparatus of claim 1, wherein the non-feed element includes an element portion having a folding back portion bent on a feed side of the feed element and the folding back portion is set as the feed-side coupling portion.

12. The antenna apparatus of claim 1, wherein the non-feed element includes an element portion having a folding back portion bent on an open side of the feed element and the folding back portion is set as an open-side coupling portion.

13. The antenna apparatus of claim 1, wherein the feed element is disposed on a dielectric material.

14. The antenna apparatus of claim 1, wherein the non-feed element is supported by a housing with the circuit substrate built therein.

15. A radio communicating apparatus using an antenna apparatus capable of multifrequency resonance, comprising:

a feed element supplied with electricity;

a single or a plurality of non-feed element(s) disposed over a circuit substrate or outside the circuit substrate having a feeding portion disposed for supplying electricity to the feed element, the non-feed element(s) having an end by which the non-feed element(s) is located adjacent to the feed element; and a single or a plurality of coupling portion(s) that electromagnetically couples the feed element to the non-feed element(s) by the end, the feed element including first and second antenna element units which have different element length, the first and second antenna element units being formed from a connecting portion to the feeding portion that is on the circuit substrate, the antenna apparatus resonating in a frequency band of the feed element, the antenna apparatus resonating in a frequency band of the non-feed element.

16. The radio communicating apparatus of claim 15, wherein the coupling portion is one or both of a feed-side coupling portion that electromagnetically couples a feed side of the feed element to the non-feed element and an open-side coupling portion that electromagnetically couples an open side of the feed element to the non-feed element.

17. The radio communicating apparatus of claim 15, wherein the feed element includes a feed connecting unit connected to the feeding portion and a plurality of element portions branched from the feed connecting unit, the element portions each having a resonant frequency different for each element portion.

18. The radio communicating apparatus of claim 15, wherein the feed element is located with an element portion bent within a width corresponding to a width of the circuit substrate to establish an antenna length necessary for resonance in a frequency band that should be set.

19. The radio communicating apparatus of claim 15, wherein the feed element connects a feed connecting unit to the feeding portion of the circuit substrate and locates an element portion outside the circuit substrate.

20. The radio communicating apparatus of claim 15, wherein the feed element includes an element portion located parallel to an edge of the circuit substrate.

21. The radio communicating apparatus of claim 15, wherein the non-feed element includes an element portion disposed in the vicinity of the feed element connected to the feeding point of the circuit substrate.

22. The radio communicating apparatus of claim 15, wherein the non-feed element includes an element portion disposed in the vicinity of an open side of the feed element.

23. The radio communicating apparatus of claim 15, wherein the non-feed element includes an element portion located parallel to the feed element.

24. The radio communicating apparatus of claim 15, wherein the non-feed element includes an element portion having a folding back portion bent on a feed side of the feed element and the folding back portion is set as the feed-side coupling portion.

25. The radio communicating apparatus of claim 15, wherein the non-feed element includes an element portion having a folding back portion bent on an open side of the feed element and the folding back portion is set as an open-side coupling portion.

26. The radio communicating apparatus of claim 15, wherein the feed element is disposed on a dielectric material.

27. The radio communicating apparatus of claim 15, wherein the non-feed element is supported by a housing with the circuit substrate built therein.

* * * * *